US009447661B2

(12) United States Patent
Broussard et al.

(10) Patent No.: US 9,447,661 B2
(45) Date of Patent: Sep. 20, 2016

(54) GRAVEL PACK AND SAND DISPOSAL DEVICE

(75) Inventors: John P. Broussard, Kingwood, TX (US); Christopher A. Hall, Cypress, TX (US); Patrick J. Zimmerman, Houston, TX (US); Brian J. Ritchey, Hockley, TX (US); Ronald van Petegem, Montgomery, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 635 days.

(21) Appl. No.: 13/614,569

(22) Filed: Sep. 13, 2012

(65) Prior Publication Data

US 2013/0008652 A1 Jan. 10, 2013

Related U.S. Application Data

(63) Continuation-in-part of application No. 13/345,500, filed on Jan. 6, 2012, now Pat. No. 9,085,960, and a continuation-in-part of application No. 12/913,981, filed on Oct. 28, 2010, now Pat. No. 8,770,290.

(60) Provisional application No. 61/632,403, filed on Sep. 16, 2011.

(51) Int. Cl.

| | |
|---|---|
| ***E21B 43/08*** | (2006.01) |
| ***E21B 33/124*** | (2006.01) |
| ***E21B 43/04*** | (2006.01) |

(Continued)

(52) U.S. Cl.

CPC ..... *E21B 43/04* (2013.01); *E21B 33/124* (2013.01); *E21B 34/14* (2013.01); *E21B 43/045* (2013.01); *E21B 43/12* (2013.01); *E21B 43/14* (2013.01); *E21B 43/08* (2013.01); *E21B 2034/007* (2013.01)

(58) Field of Classification Search

USPC ..... 166/276, 278, 51, 157, 158, 205, 332.4, 166/227–236

See application file for complete search history.

(56) References Cited

U.S. PATENT DOCUMENTS

| | | | |
|---|---|---|---|
| 3,134,439 | A | 5/1964 | Shields |
| 4,105,069 | A | 8/1978 | Baker |

(Continued)

FOREIGN PATENT DOCUMENTS

| | | | |
|---|---|---|---|
| GB | 2387401 | A | 10/2003 |
| RU | SU1810500 | A1 | 4/1993 |

(Continued)

OTHER PUBLICATIONS

Examiners Requisition received in corresponding Canadian Application No. 2,789,859, dated Feb. 19, 2014, 3 pages.

(Continued)

*Primary Examiner* — Blake Michener
(74) *Attorney, Agent, or Firm* — Blank Rome, LLP

(57) ABSTRACT

An apparatus and method allow gravel pack slurry to be placed in a borehole annulus from the toe towards the heel to reduce the pressure acting upon the heel of the borehole during the gravel placement operation. By reducing the pressure on the heel, the gravel pack slurry may be placed in longer sections of the borehole in a single operation. Additionally, excess slurry in the inner string can be disposed in the borehole annulus around the shoe track of the apparatus, and fluid returns can flow up the apparatus through a bypass.

37 Claims, 12 Drawing Sheets

(51) Int. Cl.

| | |
|---|---|
| ***E21B 34/14*** | (2006.01) |
| ***E21B 43/12*** | (2006.01) |
| ***E21B 43/14*** | (2006.01) |
| *E21B 34/00* | (2006.01) |

(56) References Cited

U.S. PATENT DOCUMENTS

| | | | | |
|---|---|---|---|---|
| 4,440,218 | A | 4/1984 | Farley | |
| 4,474,239 | A | 10/1984 | Colomb et al. | |
| 5,269,375 | A | 12/1993 | Schroeder, Jr. | |
| 5,934,376 | A | 8/1999 | Nguyen et al. | |
| 6,003,600 | A | 12/1999 | Nguyen et al. | |
| 6,230,801 | B1 * | 5/2001 | Hill et al. | 166/278 |
| 6,253,851 | B1 | 7/2001 | Schroeder, Jr. et al. | |
| 6,371,210 | B1 | 4/2002 | Bode et al. | |
| 6,446,722 | B2 | 9/2002 | Nguyen et al. | |
| 6,588,507 | B2 | 7/2003 | Dusterhoft et al. | |
| 6,601,646 | B2 | 8/2003 | Streich et al. | |
| 6,675,891 | B2 | 1/2004 | Hailey, Jr. et al. | |
| 6,749,023 | B2 | 6/2004 | Nguyen et al. | |
| 6,857,476 | B2 | 2/2005 | Richards | |
| 6,983,795 | B2 | 1/2006 | Zuklic et al. | |
| 7,017,664 | B2 | 3/2006 | Walker et al. | |
| 7,331,388 | B2 | 2/2008 | Vilela et al. | |
| 7,367,395 | B2 | 5/2008 | Vidrine et al. | |
| 7,472,750 | B2 | 1/2009 | Walker et al. | |
| 8,770,290 | B2 * | 7/2014 | van Petegem et al. | 166/278 |
| 2003/0000702 | A1 | 1/2003 | Streich | |
| 2003/0037925 | A1 | 2/2003 | Walker et al. | |
| 2004/0134656 | A1 | 7/2004 | Richards | |
| 2004/0211559 | A1 | 10/2004 | Nguyen et al. | |
| 2006/0060352 | A1 * | 3/2006 | Vidrine et al. | 166/276 |
| 2006/0231253 | A1 | 10/2006 | Vilela et al. | |
| 2007/0187095 | A1 | 8/2007 | Walker et al. | |
| 2008/0099194 | A1 | 5/2008 | Clem | |
| 2009/0095471 | A1 | 4/2009 | Guignard et al. | |
| 2009/0133875 | A1 | 5/2009 | Tibbles et al. | |
| 2010/0096130 | A1 | 4/2010 | Parlar et al. | |
| 2010/0263864 | A1 | 10/2010 | Chay et al. | |

FOREIGN PATENT DOCUMENTS

| | | | |
|---|---|---|---|
| RU | 2374431 | C2 | 8/2008 |
| SU | 1191563 | A | 11/1985 |
| WO | 2005049954 | A2 | 6/2005 |
| WO | 2007126496 | | 11/2007 |

OTHER PUBLICATIONS

Extended Search Report received in counterpart European Appl. No. 12184724.8, dated Jan. 9, 2013.

Schlumberger, "Alternate Path Screens," obtained from www.slb.com/oilfield, dated Jan. 2004, 4 pages.

Schlumberger, "FloRite—Inflow control device," obtained from www.slb.com/transcend, (c) 2009, 2 pages.

Halliburton, "Sand Control: Horizon Low Density, Lightweight Gravel," obtained from www.halliburton.com, (c) 2006, 2 pages.

Edment, Brian, et al., "Improvements in Horizontal Gravel Packing," Oilfield Review, Spring 2005, pp. 50-60.

Synopsis of SPE 38640 by Jones, L.G., et al., "Shunts Help Gravel Pack Horizontal Wellbores with Leakoff Problems," Journal of Petroleum Technology, Mar. 1998, pp. 68-69.

Coronado, Martin, et al., "Completing extended-reach, open-hole, horizontal well," obtained from http://www.offshore-mag.com/index/article-tools-template, generated on May 12, 2010, 5 pages.

Schlumberger, "ResFlow Inflow Control Devices and MudSolv Filtercake Removal Equalize Inflow and Restart Wells," obtained from www.slb.com/sandcontrol, (c) 2010, 2 pages.

Weatherford, "Model 4P Retrievable Seal-Bore Packer Gravel-Pack System," obtained from www.weatherford.com, (c) 2005-2009, 2 pages.

Brannon, D.H., et al., "A Single-Trip, Dual-Zone Gravel Pack System Successfully Gravel Packs Green Canyon Area Wells, Gulf of Mexico," SPE 21670, (c) 1991, 7 pages.

Weatherford, "Hydraulic-Release Hookup Nipple Circulating Gravel-Pack System," obtained from www.weatherford.com, (c) 2005, 2 pages.

Weatherford, "Conventional Well Screens," obtained from www.weatherford.com, (c) 2004-2009, 16 pages.

Weatherford, "Model WFX Setting Tools," obtained from www.weatherford.com, (c) 2007-2008, 2 pages.

Weatherford, "Model WFX Crossover Tool," obtained from www.weatherford.com, (c) 2007-2008, 2 pages.

Weatherford, "Real Results: Completion Package Eliminates Sand Production, Enhances Reliability in Siberian Oil-Production Well," obtained from www.weatherford.com, (c) 2009, 1 page.

First Office Action in counterpart Russian Appl. No. 2011143515, dated Nov. 26, 2012.

First Examination Report in counterpart Australian Appl. 2012216843, dated Jan. 20, 2014.

Decision on Grant in counterpart Russian Appl. No. 2011143515, dated Mar. 7, 2013.

First Office Action received in counterpart Canadian Appl. No. 2,755,623, dated Jun. 14, 2013.

First Office Action received in counterpart Australian Appl. No. 2011236063, dated May 21, 2013.

First Office Action received in counterpart U.S. Appl. No. 12/913,981, dated May 6, 2013.

Response to First Office Action received in counterpart U.S. Appl. No. 12/913,981, dated May 6, 2013.

Dawson, M. E. P., et al., "World's First Reverse-Port Uphill Openhole Gravel Pack With Swellable Packers" Society of Petroleum Engineers, SPE 122765, Jan. 1, 2009.

Second Examiner's Requisition in corresponding Canadian Appl. 2,789,859, dated Apr. 8, 2015.

Second Patent Examination Report in corresponding Australian Appl. 2012216843, dated Feb. 27, 2015.

* cited by examiner

GRAVEL PACK AND SAND DISPOSAL DEVICE

CROSS-REFERENCE TO RELATED APPLICATIONS

This is a continuation-in-part of U.S. application Ser. No. 13/345,500, filed 6 Jan. 2012 and entitled "Gravel Pack Bypass Assembly," which claims the benefit of U.S. Provisional Appl. No. 61/632,403, filed 16 Sep. 2011 and entitled "Single Port Gravel Pack and Sand Disposal Device" and which is a continuation-in-part of U.S. application Ser. No. 12/913,981, filed 28 Oct. 2010 and entitled "Gravel Pack Assembly for Bottom Up/Toe-to-Heel Packing," each of which is incorporated herein by reference and to which priority is claimed.

BACKGROUND OF THE DISCLOSURE

Some oil and gas wells are completed in unconsolidated formations that contain loose fines and sand. When fluids are produced from these wells, the loose fines and sand can migrate with the produced fluids and can damage equipment, such electric submersible pumps (ESP) and other systems. For this reason, completions for these wells can require sand screens for sand control. For hydrocarbon wells, esp. horizontal wells, the completion has screen sections with a perforated inner tube and an overlying screen portion. The purpose of the screen is to block the flow of particulate matter into the interior of the production tubing.

Even with the sand screen, contaminants and particulate matter can still enter the production tubing. The particulate matter usually occurs naturally or is part of the drilling and production process. As the production fluids are recovered, the particulate matter can cause a number of problems because the material is usually abrasive and can reduce the life of any associated production equipment. By controlling and reducing the amount of particulate matter pumped to the surface, operators can reduce overall production costs.

Some the particulate matter may be too large to be produced and may still cause problems at the downhole sand screens. As the well fluids are produced, for example, the larger particulate matter becomes trapped in the filter element of the sand screen. Over the life of the well as more and more particulate matter is trapped in the filter elements, the filter elements become clogged and restrict flow of the well fluids to the surface.

A gravel pack operation is one way to reduce the inflow of particulate matter before it reaches the sand screen. In the gravel pack operation, gravel (e.g., sand) is packed in the borehole annulus around the sand screen. The gravel is a specially sized particulate material, such as graded sand or proppant. When packed around the sand screen in the borehole annulus, the packed gravel acts as a filter to keep any fines and sand of the formation from migrating with produced fluids to the sand screen. The packed gravel also provides the producing formation with a stabilizing force that can prevent the borehole annulus from collapsing.

Horizontal wells that require sand control are typically open hole completions. In the past, stand-alone sand screens have been used predominately in these horizontal open holes. However, operators have also been using gravel packing in these horizontal open holes to deal with sand control issues. For example, FIG. 1A shows a borehole 10, which is a horizontal open hole, having a prior art gravel pack assembly 20 extend from a packer 14 downhole from casing 12. In the typical gravel packing operation, a screen

25 and a packer 14 are run into the wellbore together. Once the screen 25 and packer 14 are properly located, the packer 14 is set so that it forms a seal between wellbore and the screen 25 and isolates the region above the packer 14 from the region below the packer 14. The screen 25 is also attached to the packer 14 so that it hangs down in the wellbore forming an annular region around the exterior portion of the screen 25. The bottom of the screen 25 is sealed so that any fluid that enters the screen 25 can only pass through the screening or filtering material. The upper end of the screen 25 is usually referred to as the heel and the lower end of the screen 25 is usually referred to as the toe of the well.

To control sand in produced fluid from the borehole 10, operators attempt to fill the annulus between the assembly 20 and the borehole 10 with gravel (e.g., graded sand) by pumping a slurry of transport fluid and gravel into the borehole 10 to pack the annulus around the screen assembly 20. For the horizontal open borehole 10, operators pack the annulus using an alpha-beta wave (or water packing) technique, which uses a low-viscosity transport fluid, such as completion brine, to carry the gravel.

Initially, a washpipe 40 and crossover tool 30 are put together on an inner work string 45 at the surface and then run into the borehole to sting into the packer 14, pass through the packer 14, and run into the screen 20. The run-in of the washpipe 40 continues until the crossover tool 30 lands on the packer 14. The crossover tool 30 is usually dimensioned so that the packer 14 forms a second seal around the crossover tool 30 so that virtually no fluid is allowed to pass from above or below the packer 14 without passing through the ports 32 and 34 on the crossover tool 30.

After positioning the washpipe 40 into the screen 25, operators pump the slurry of transport fluid and gravel down the inner work string 45. The slurry passes through an exit port 32 in the crossover tool 30 and into the annulus between the screen 25 and the borehole 10 downhole from the packer 14. As the slurry moves in the annulus, the transport fluid in the slurry then leaks off through the formation and/or through the screen 25. However, the screen 25 prevents the gravel in the slurry from flowing back into the screen 25. The fluid returns passing alone through the screen 25 can then return through the crossover port 34 and into the annulus above the packer 14.

As the fluid leaks off, the gravel drops out of the slurry and first packs along the low side of the borehole's annulus. Traveling from the heel of the well toward the toe along the outside of the screen, the gravel collects in stages 16*a*, 16*b*, etc., which progress from the heel to the toe in what is termed an alpha wave. Because the borehole 10 is horizontal, gravitational forces dominate the formation of this alpha wave, and the gravel settles along the low side at an equilibrium height along the screen 25.

All the while, the transport fluid that carries the gravel drains inside the screen. As the fluid drains, pumping the slurry down the wellbore becomes increasingly difficult. Once a certain portion of the screen is covered, the gravel will start building back from the toe towards the heel in a beta wave, to completely pack off the screen from approximately its furthest point of deposit towards the heel. For example, the gravel begins to collect in stages (not shown) of the beta wave and forms along the upper side of the screen 25 starting from the toe and progressing to the heel of the screen 25. Again, the transport fluid carrying the gravel can pass through the screen 25 and up the washpipe 40.

To complete the beta wave, the gravel pack operation must have enough fluid velocity to maintain turbulent flow and move the gravel along the topside of the annulus. As the gravel fills back towards the heel, however, the open area to flow decreases, and the pressure on the formation increases. A high pressure area develops at the heel due to increasing pump pressure. Yet, the heel may be particular sensitive to pressure due to the type of formation involved because hard rock formations do not require a gravel pack. Instead, the types of formations needing gravel packing are typically sandstone, which has a much lower fracture gradient and a much lower compressive strength than a carbonite or shale reservoir. Oftentimes, the operators apply pump pressure at or near the fracture gradient of the formation with the completion brine hydrostatic pressure alone. Thus, as pressure is increased during the gravel pack operation, the operators may exceed the fracture gradient and may fracture the formation unintentionally. In these instances, well control can become an issue in addition to any damaging effects caused by losing fluid to the formation.

After the annular area around the screen has been packed with gravel, operators reposition the crossover tool 30 to reverse out. To do this, the ports 32 used for depositing the sand slurry into the annulus are raised above the packer 14, and the operators pump gravel free fluid down the annular area around the exterior of the workstring 45 to reverse the fluid inside of the workstring 45 back to surface. This pumping removes any the excess sand or gravel, but leaves the gravel that was placed around the exterior of the screen 25 in place.

Although the alpha-beta technique can be economical due to the low-viscosity transport fluid and regular types of screens that can be used, some situations may require a viscous fluid packing technique that uses an alternate path. In this technique, shunts disposed on the screen divert pumped packing slurry along the outside of the screen. FIG. 1B shows an example assembly 20 having shunts 50 and 52 (only two of which are shown). Typically, the shunts 50/52 for transport and packing are attached eccentrically to the screen 25. The transport shunts 50 feed the packing shunts 52 with slurry, and the slurry exits from nozzles 54 on the packing shunts 52. By using the shunts 50/52 to transport and pack the slurry, the gravel packing operation can avoid areas of high leak off in the borehole 10 that would tend to form bridges and impair the gravel packing.

Prior art gravel pack assemblies 20 for both techniques of FIGS. 1A-1B have a number of challenges and difficulties. During a gravel pack operation in a horizontal well, for example, the crossover ports 32/34 may have to be reconfigured several times. The slurry pumped can sometimes dehydrate within the assembly's crossover tool 30 and associated sliding sleeve (not shown). If severe, settled sand or dehydrated slurry can stick the service tools and can even junk the well. Additionally, the crossover tool 30 is subject to erosion during gravel pack operations, and the crossover tool 30 can stick in the packer 14, which can create extremely difficult fishing jobs.

To deal with gravel packing in some openhole wells, a Reverse-Port Uphill Openhole Gravel Pack system has been developed as described in SPE 122765, entitled "World's First Reverse-Port Uphill Openhole Gravel Pack with Swellable Packers" (Jensen et al. 1009). This system allows an uphill openhole to be gravel packed using a port disposed toward the toe of the hole.

SUMMARY OF THE DISCLOSURE

There are certain advantages in an apparatus and method contemplated herein where an inner string or washpipe (and not the formation) contains the pressure from the pumps during a gravel pack operation. The alpha wave of the gravel pack slurry forms from the toe towards the heel in the borehole annulus, and the beta wave forms from the heel to the toe in the borehole annulus. As the alpha and beta waves form, the formation pressure can remain approximately constant.

In the disclosed system, a sealing device and a screen assembly are run into the wellbore. The sealing device may typically be a packer and may or may not have slips depending upon the wellbore and the operator's requirements. In fact, the sealing device could incorporate any type of sealing system, such as a swelling elastomer, a polished bore rod and receptacle, or any suitable sealing system. The sealing device is set so that it seals the borehole annulus around the screen assembly.

Towards the toe of the borehole, the screen assembly can have a blank section of pipe followed by a section of screen. In certain embodiments, the screen assembly may not be a blank section. Regardless, the screen assembly has sealing elements that divide the interior of the screen assembly into at least two sections. The sections can be isolated from the other during operations when the sealing elements seal against an inner string or washpipe disposed in the interior as discussed below. Although the sealing elements may be attached inside the interior of the screen assembly, sealing elements may be attached to the inner string and placed in the interior of the screen assembly contemporaneously with the inner string or placed in the interior independently.

During a gravel pack operation, the inner string is run into the wellbore and passes into and through the sealing device or packer. In certain embodiments, the inner string may be run into the wellbore simultaneously with or as a part of the screen assembly, the packer, or both, but the packer does not seal against the inner string.

For its part, the inner string has an outlet port towards its distal end that allows fluid to flow out of the inner string. Further towards the distal end of the inner string, a plug seals in a seat in the inner string and blocks fluid from flowing through the inner string out the distal end. The plug in the inner string may be dropped ball, a bridge plug, an elastomer seal, a swellable seal, a solid tubular or a solid section of tubular, a closed valve, or any other device that may block the flow of fluid through the inner string.

When run into the screen assembly, the outlet port in the inner string is located at the flow port in the screen assembly, and the assembly's internal sealing elements seal against the inner string. This allows fluid access through various ports and in various directions depending upon the position of the inner string as discussed below. In general, two sealing element are disposed on either side of the assembly's flow port. A third sealing element may be located further downhole towards the toe.

With the inner string's outlet port communicating with the assembly's flow port, a slurry of transport fluid and gravel is pumped down the inner string. The slurry exits the inner string through the outlet port, passes out the assembly's flow port, and enters the annulus around the screen assembly to being packing the annulus around the screen assembly. The gravel may be any material such as sand, gravel, crushed nut shells, or any other proppant that can be pumped into the wellbore as a slurry when mixed with a transport fluid and that can later act as a wellbore support, a filter, or both.

As the slurry is pumped into the borehole annulus, the pressure from the pumps is exerted on the inner string and not on the formation. The slurry flows towards the upper end or heel of the annulus, and the transport fluid is drained out of the slurry into the interior of the screen assembly, thus provoking the gravel packing Alpha wave and the consequent Beta wave to pack the borehole annulus detailed above. Meanwhile, a bypass, which can be a tube or conduit communicates a downhole second of the assembly's interior with an uphole section so that the flow port is bridged. This allows fluid returns downhole of the flow port to bypass the flow port. In any event, the fluid returns flow uphole in the screen assembly towards the heel, past the packer, into the annulus between the inner string and wellbore or casing, and then to the surface.

In another embodiment, while similar to that noted above, the annular area between the screen assembly and the inner string is isolated by the sealing elements located near each end of the bypass so that the slurry flows out of the inner string into the annular area created between the screen assembly and the inner string. The slurry is then forced out of the annular area though the flow port in the screen and into the annulus formed by the screen assembly and the wellbore.

However, in this embodiment, the area below the flow port is not closed-in so that the slurry is allowed to flow both towards the upper section of the screen assembly and in the same operation the slurry also flows towards the lower section of the screen assembly. As the slurry moves towards both the upper and lower sections, the transport fluid is drained out of the slurry into the interior of the screen assembly, thus provoking gravel packing of the borehole annulus. As the transport fluid is drained from the slurry, the fluid returns pass into the interior of the screen assembly and then flow to the surface.

Typically when the wellbore is packed off, the operator will notice a pressure spike at the surface. When this occurs the pumps are shut off and the inner string is prepared to be removed. However, sand or gravel left in the inner string may fill the interior of the screen assembly, which is not desirable. To minimize any excess sand or gravel being dumped in the screen assembly, any excess slurry in the inner string is preferably removed from the inner string and dumped in the borehole annulus around the screen assembly.

To backwash the sand out of the inner string while leaving the gravel pack intact, the inner string is raised a predetermined distance so that there is access from a second port in the inner string that is below the plug and the bypass tube. Clear fluid is then pumped down the inner string. Now, however, because of the gravel packed into the annulus towards the heel of the wellbore the fluid passes out of the outlet port in the inner string pipe and through the flow port in the screen assembly as before, but the clear fluid and excess slurry may instead move towards the toe of the borehole towards a second screen in the screen assembly. Typically, the amount of gravel slurry that was initially pumped during the gravel pack operation was pre-calculated to just fill the annulus around the screen assembly. Therefore, the amount of excess gravel that remains in the inner string may not be enough to pack gravel fully around the assembly's second screen, but this can be calculated as well.

While pumping the clear fluid to dump the excess slurry, the transport fluid is drained away from the remaining slurry through the second screen and is forced into the interior of the inner string below the inner string's plug. The fluid returns then pass uphole in the screen assembly. At this point, the fluid returns enter the bypass communicating around the flow port in the screen assembly. After traveling through the bypass, the fluid returns then flow back in the interior of the screen assembly and up and out of the wellbore.

Other embodiments include an apparatus for redirecting particulate matter slurry having a packer and a screen assembly where the screen assembly has an interior, an exterior, a first annulus around the exterior of the screen assembly, and at least one flow port allowing a slurry to pass out of the screen assembly. The screen assembly is supported by the packer, and an inner string is used to pump slurry into the borehole annulus to pack around the screen assembly.

The inner string is located in the interior of the screen assembly forming a second annulus between the screen and the inner string. The inner string has a plug and a port. The plug blocks fluid flow through the inner string, and the port is located upstream of the plug to allow the slurry to flow from the inner string through the opening into the first annulus. Additionally, the apparatus may include a packer and screen assembly placed in a wellbore having a toe and a heel. The packer may be located near the heel of the wellbore. The packer has an interior and an exterior, a seal about the exterior, and a fluid pathway about its interior. The packer seals the screen assembly to the wellbore and provides a fluid pathway about its interior. The plug is located toward the toe of the wellbore so the slurry flows from the opening in the screen assembly towards the packer.

Another embodiment may include an apparatus for redirecting particulate matter slurry with a packer and a screen assembly. The screen assembly is supported by the packer and has an upper end, a lower end, an interior, an exterior, a first filter section, a second filter section, a blank section between the first filter section and the second filter section, an opening in the blank section, and a first annulus about the exterior of the screen assembly. An inner string has an upper end, an internal plug, and a lower end. The inner string is run into the interior of the screen assembly. The plug blocks the flow of slurry between the upper end and the lower end of the inner string. On either side of the plug, the inner string has at least two outlet ports. When the inner string is in a first position in the screen assembly, a first of the ports allows the slurry to flow from the upper end of the inner string, through the assembly's flow port, and to the borehole annulus to pack around the screen assembly with gravel. When the inner string is in a second position in the screen assembly, a second of the ports allows fluid returns to flow from the lower end of the inner string, into a bypass on the screen assembly, past the flow port, and up the interior of the screen assembly.

The bypass communicates the lower end of the screen assembly's interior past the flow port to the upper end of the screen assembly's interior. When the inner string is in the second position in the screen assembly to dump excess slurry into the borehole annulus, for example, fluid returns enter the screen assembly towards the toe through the second filter section. The fluid returns enter the lower end of the inner string, pass out the second port, into the bypass, and then to the assembly's interior uphole of the flow port.

Another embodiment is a method of redirecting particulate matter slurry includes assembling a packer and a screen assembly and deploying them in a borehole. The screen assembly has an interior and at least one flow port allowing slurry to flow out of the interior. The screen assembly is supported on the packer. To perform a gravel pack operation, an inner string is located in the interior of the screen assembly, and slurry is flowed down the inner string. The flow of slurry through the inner string is blocked with a plug, but the slurry can flow from an outlet on the inner string, through the flow port, and into the borehole annulus.

Another embodiment is a method for redirecting particulate matter slurry where a packer and a screen assembly are run into a borehole. The screen assembly has an interior, a first filter section, a second filter section, a blank section between the first filter section and the second filter section, and a flow port in the blank section. When run in the borehole, the screen assembly is supported on the packer. To perform gravel pack operations, the inner string is run into the interior of the screen assembly after the packer is set, or it may be run into the wellbore simultaneously with the packer or screen assembly. The inner string has an upper end, an internal plug, and a lower end. The inner string is placed in a first position so that the slurry flows out an outlet port on the inner string, through the assembly's flow port, and into the borehole annulus. Fluid returns then enter the screen assembly through the first filter section. Subsequently, the inner string is placed in a second position so that the slurry can still flow from the string's outlet port, through the assembly's flow port, and to the borehole annulus. However, fluid returns enter the screen assembly through the second filter section and bypass the flow port so the fluid returns can flow uphole through the interior of the screen assembly. In this embodiment, the screen assembly can have a bypass communicating the interior of the screen assembly downhole of the flow port with the interior of the screen assembly uphole of the flow port. In one embodiment, the fluid returns entering through the second filter section enter the lower end of the inner string, travel out of a second outlet port on the inner string, pass into the bypass, and then travel back to the screen assembly's interior uphole of the flow port. In another embodiment, the fluid returns entering through the second filter section may pass directly into the bypass and then travel back to the screen assembly's interior uphole of the flow port.

Typically, after the gravel packing operation and subsequent gravel backwash or cleanup operation, it is usually necessary to remove the inner string. In certain embodiments, there is a flapper or other type of isolation device located in the interior of the screen assembly upstream of the assembly's flow port. The isolating device prevents the gravel slurry from flowing back into the interior of the screen assembly. In some cases, other types of isolation devices may be used such as bridge plugs, swellable plugs, or any other type of sealing device that can be placed in position by the inner string or run into the wellbore on other inner strings.

DETAILED DESCRIPTION

Various gravel pack systems are disclosed in incorporated U.S. application Ser. Nos. 12/913,981 and 13/345,500. Details related to such disclosed gravel pack systems and additional embodiments are disclosed herein below.

Figure 1A:
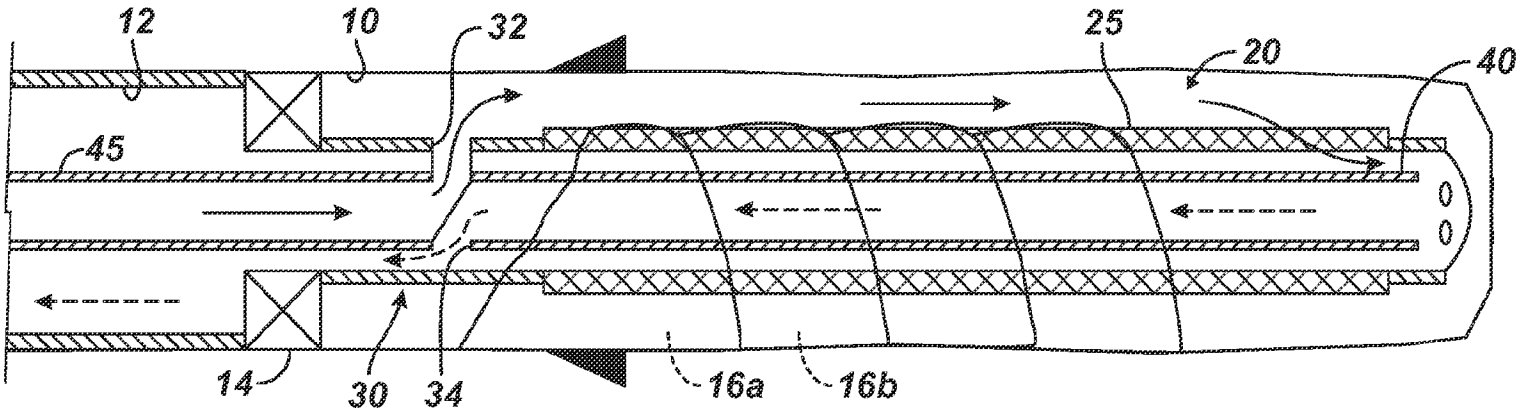
FIG. 1A (Prior Art)
FIGS. 1A-1B illustrate gravel pack assemblies according to the prior art.
Figure 1B:
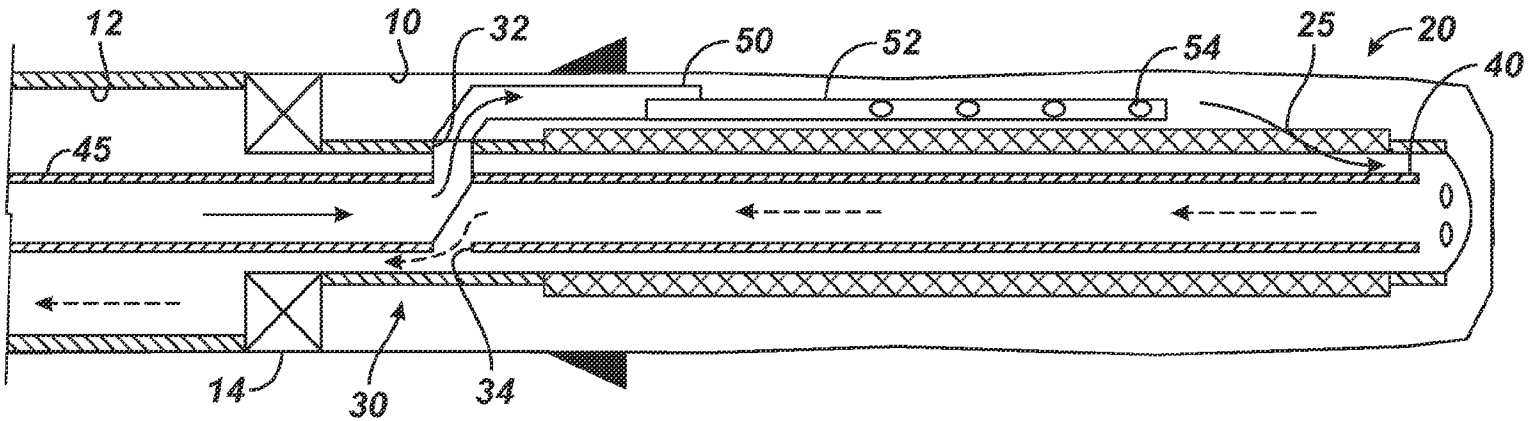
FIG. 1B (Prior Art)
Figure 2:
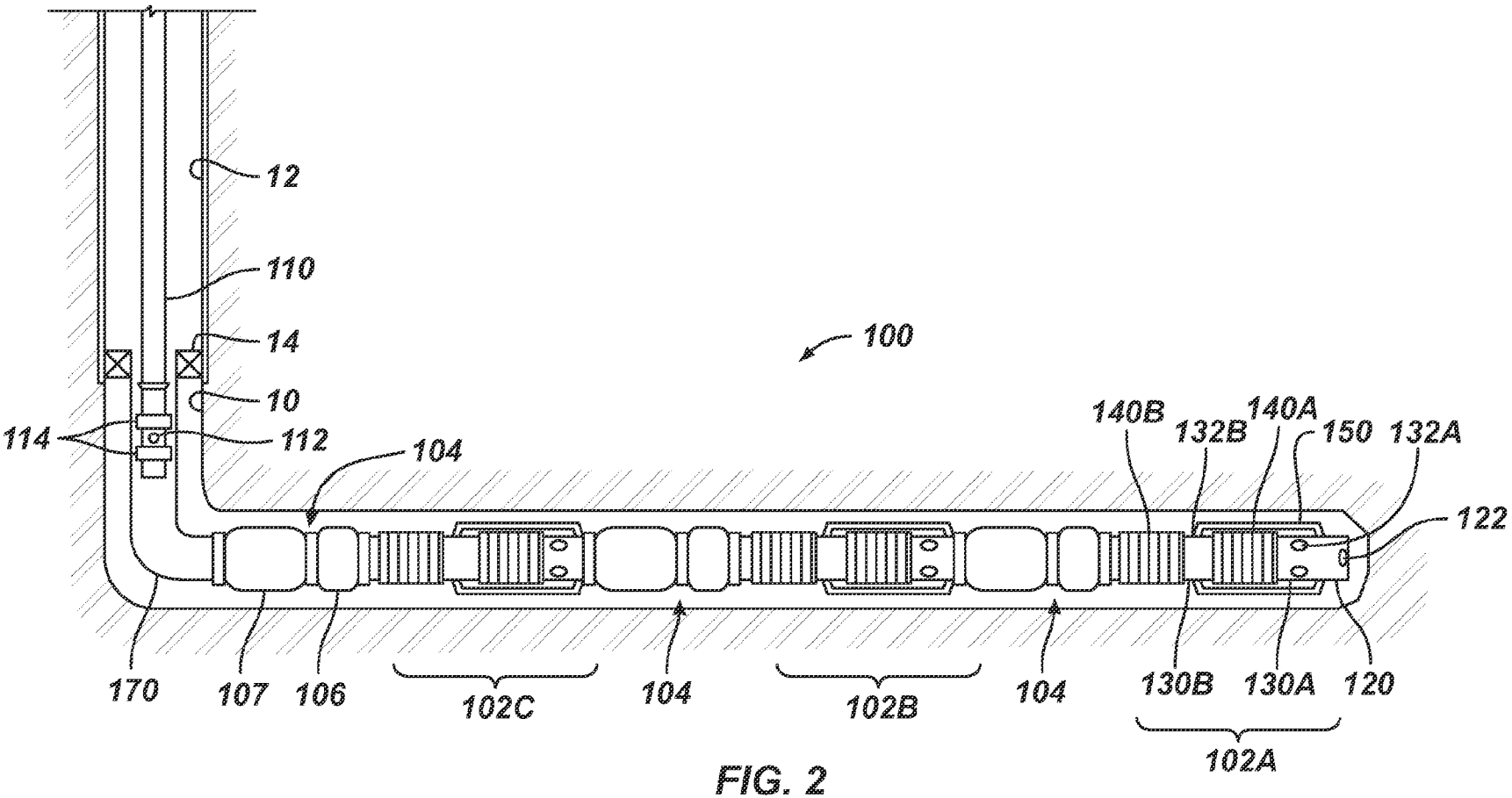
FIG. 2 shows a gravel pack assembly according to the present disclosure having screen sections separated by packers.

FIG. 2 shows a gravel pack assembly 100 having a liner 170 extending from a sealing device or liner hanger 14 and having several gravel pack sections 102A-C separated by isolating elements 104. Although shown with multiple sections 102A-C, any number of one or more sections 102 may be used in a given implementation for this and any other embodiment disclosed herein. Moreover, the sections and any screens used thereon can be of any desirable length in the borehole 10 depending on the implementation.

Having the multiple sections 102A-C, however, allows the assembly 100 to segment the borehole 10 into several compartmentalized reservoir zones so that multiple gravel or frac pack operations can be performed separately in each zone. The isolating elements 104 and gravel pack sections 102A-C are deployed into the well in a single trip. The isolating elements 104, referred to herein as packers for convenience, can have one packer or a combination of packers to isolate the gravel pack sections 102A-C from one another. Any suitable packers can be used and can include hydraulic or hydrostatic packers 106 and swellable packers 107, for example, used alone or in combination with one another as shown.

As can be seen in this and other embodiments disclosed herein, the liner 170 and the gravel pack sections 102A-C, either together or separately, define a body or tubular that disposes in the borehole 10 and defines a body passage or interior 101 therethrough for conveying fluids to the liner hanger 14 and to the surface. Each gravel pack section 102A-C can be similar to the gravel pack assemblies disclosed in incorporated U.S. patent application Ser. No. 12/913,981. As such, each gravel pack section 102A-C has two screens 140A-B, alternate path devices or shunts 150, and housings 130A-B with flow or body ports 132A-B, although any of the other disclosed variations can be used. In addition, each section 102A-C can have other components disclosed in incorporated U.S. patent application Ser. No. 12/913,981. Finally, various details on how a service tool is used to set a packer on the liner hanger 14 and how other steps are performed are discussed in detail in the incorporated U.S. patent application Ser. No. 12/913,981, so they are not repeated here.

Turning briefly to gravel pack operations of the assembly 100, an inner string or washpipe 110 initially deploys in the first gravel pack section 102A and performs a washdown. After washdown and setting of the packers 104, the assembly 100 can commence with gravel or frac pack operations in any of the various sections 102A-C. For instance, the string's outlet ports 112 with its seals 114 can isolate in fluid communication with the lower flow ports 132A in the first gravel pack section 102A to gravel or frac pack the surrounding zone in a toe-to-heel configuration.

Once packing is completed at these flow ports 132A, the inner string 110 can again be moved so that the outlet ports 112 isolate to upper flow ports 132B connected to the shunts 150. Slurry pumped down the inner string 110 can then fill the annulus around the lower end of the first gravel pack section 102A. Operations can then proceed with similar steps being repeated up the hole for each of the other gravel pack sections 102B-C separated by the packers 104.

Figure 3A:
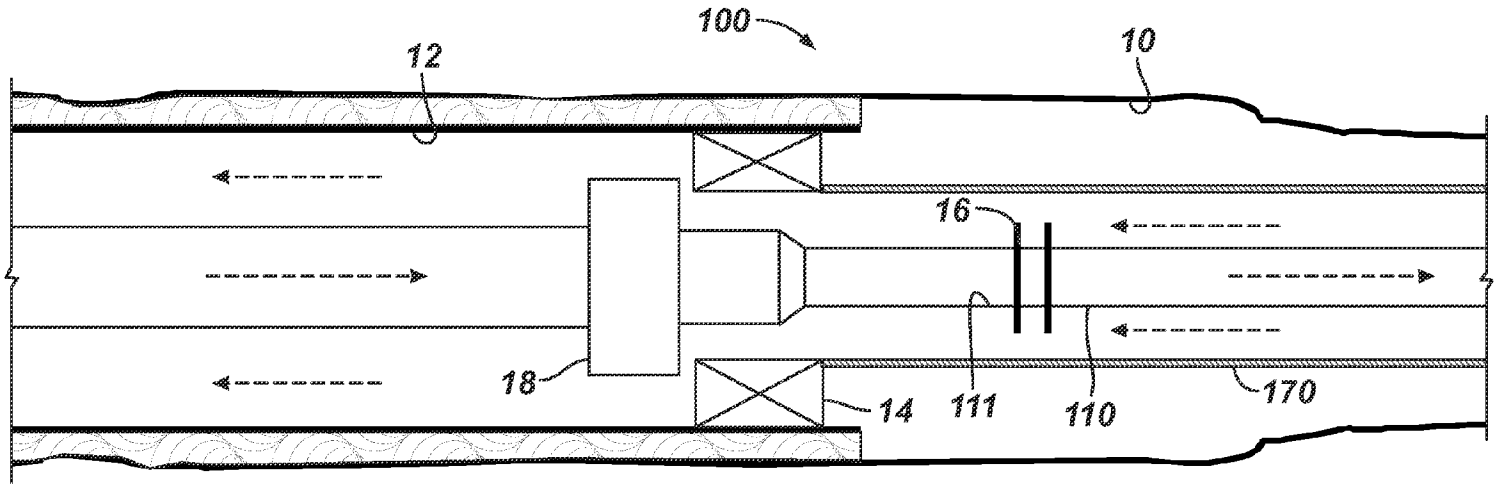
FIGS. 3A-3B show portions of the gravel pack assembly in FIG. 2 during a washdown operation.
Figure 3B:
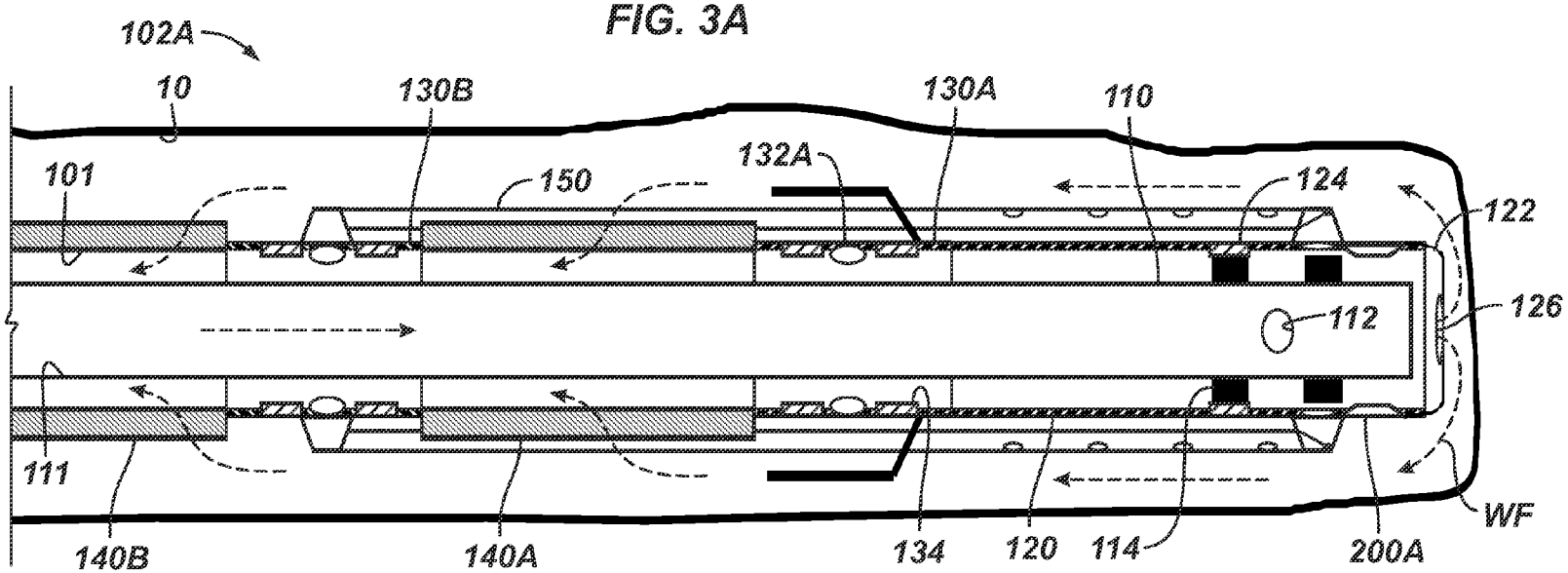

As noted above, operators initially perform a washdown operation with the assembly 100 before gravel packing. As shown in FIGS. 3A-3B, uphole and downhole portions of the assembly 100 are shown set up for a washdown operation. Uphole in FIG. 3A, the service tool 18 sits on the liner hanger 14 in the casing 12, and seals 16 on the service tool 18 do not seal in the liner hanger 14 so hydrostatic pressure can be transmitted past the seals 16. Downhole in FIG. 3B, the distal end of the inner string 110 is permanently closed or is closed by a plug, valve, ball and seat, or the like. One or more outlet ports 112 on the string 110, however, allow fluid to flow out of the string's bore 111. For washdown, the distal end of the inner string 110 fits through the screen sections 140A-B of the lower section 102A, and one of the string's seals 114 seals against a seat 124 near a float shoe 122 on the assembly's shoe track 120.

Operators circulate fluid down the bore 111 of the inner string 110, and the circulated fluid flows out the outlet ports 112, through the check valve 126 in the float shoe 122, up the annulus, and around the unset packer of the liner hanger 14 (FIG. 3A). Fluid returns can also flow in the assembly 100 through the screens 140A-B and flow uphole past the liner hanger 14.

Downhole as shown in FIG. 3B, a bypass assembly 200A is disposed near the float shoe 122 and can allow circulated fluid to pass to the borehole annulus during this process. The bypass assembly 200A can be a check valve, a screen portion, a movable sleeve, or other suitable device that allows flow of returns and not gravel from the borehole annulus to enter the assembly 100. In fact, the bypass assembly 200A as a screen portion can have any desirable length along the shoe track 120 depending on the implementation.

During the washdown, the bypass assembly 200A (if a screen or the like) can allow the circulated fluid to flow out of the shoe track 120 and into the borehole annulus, as circulated fluid is also allowed to pass out of the float shoe 122. If the bypass assembly 200A uses a check valve that allows fluid returns into the shoe track 120, fluid flow out of the bypass assembly 200A can be restricted during washdown. If the bypass assembly 200A uses a movable sleeve, fluid flow in and out of the bypass assembly 200A can be restricted during washdown by having the sleeve closed, which can be done with a suitable shifter (not shown) on the inner string 110, for example.

After washdown, gravel packing can then be performed by moving the inner string 110 to the flow ports 132A to gravel pack the borehole annulus from toe-to-heel. The seals 114 on the inner string 110 seal against the seats 134 in the housing 130A, isolating the string's outlet ports 112 with the flow ports 132A. Operators pump slurry down the inner string 112 and into the borehole annulus to gravel pack from toe to heel in an alpha-beta wave configuration. Fluid returns enter through the screens 140A-B to travel uphole.

After gravel packing at this first position, the inner string 110 can then be moved to any of the other sections 102B-C. Eventually, the inner string 110 can be moved to the this section's second flow ports 132B to further gravel pack the annulus around the shoe track 120 and/or to dispose of excess slurry from the inner string 110. As discussed in the incorporated U.S. patent application Ser. No. 12/913,981, for example, operators can evacuate excess slurry from the inner string 110 during gravel packing operations. The exterior space outside the shoe track 120 provides a volumetric space for disposing of any excess gravel remaining in the inner string 110 after gravel packing one or more of the other sections 102A-C. Operators may also intentionally gravel pack around the shoe track 120 as opposed to using it for disposing of excess slurry.

Because the shoe track 120 has the float shoe 122 that allows fluid flow out of the shoe track 120 and prevents flow into the shoe track 120, a path for return fluids is needed when slurry is pumped into the borehole annulus around the shoe track 120 to dispose of the excess slurry from the inner string 110. To illustrate how slurry can be disposed around the shoe track 120, reference is made to FIGS. 4A-4B, which show portions of the assembly 100 set up for sand disposal.

As shown, operators deploy the inner string 110 to the second flow ports 132B on the gravel pack section 102A having the shoe track 120. This can be done after operators have reached sandout while pumping slurry at the section's first flow ports 132A in the first ported housing 130A or after gravel packing has been performed on other gravel pack sections (e.g., sections 102B-C on the assembly 100 of FIG. 2). In any event, operators perform gravel packing around the shoe track 120 to clear the inner string 110 of excess slurry or to intentionally gravel pack around the shoe track 120.

Figure 4A:
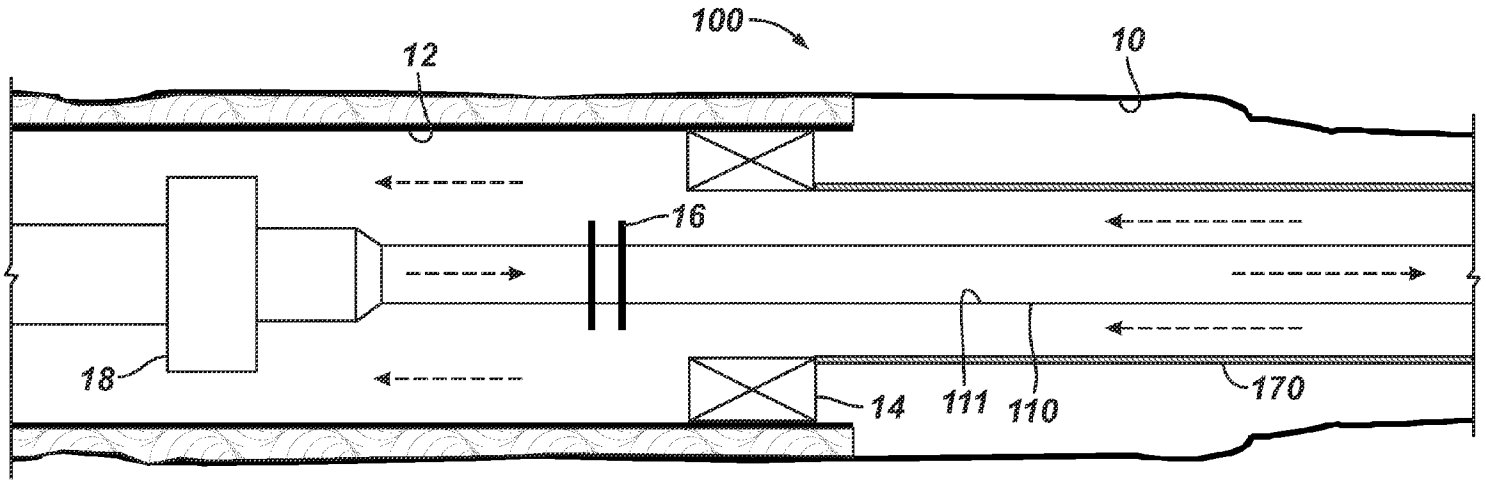
FIGS. 4A-4B show portions of the gravel pack assembly in FIG. 2 during filling of the annulus around the shoe track.
Figure 4B:
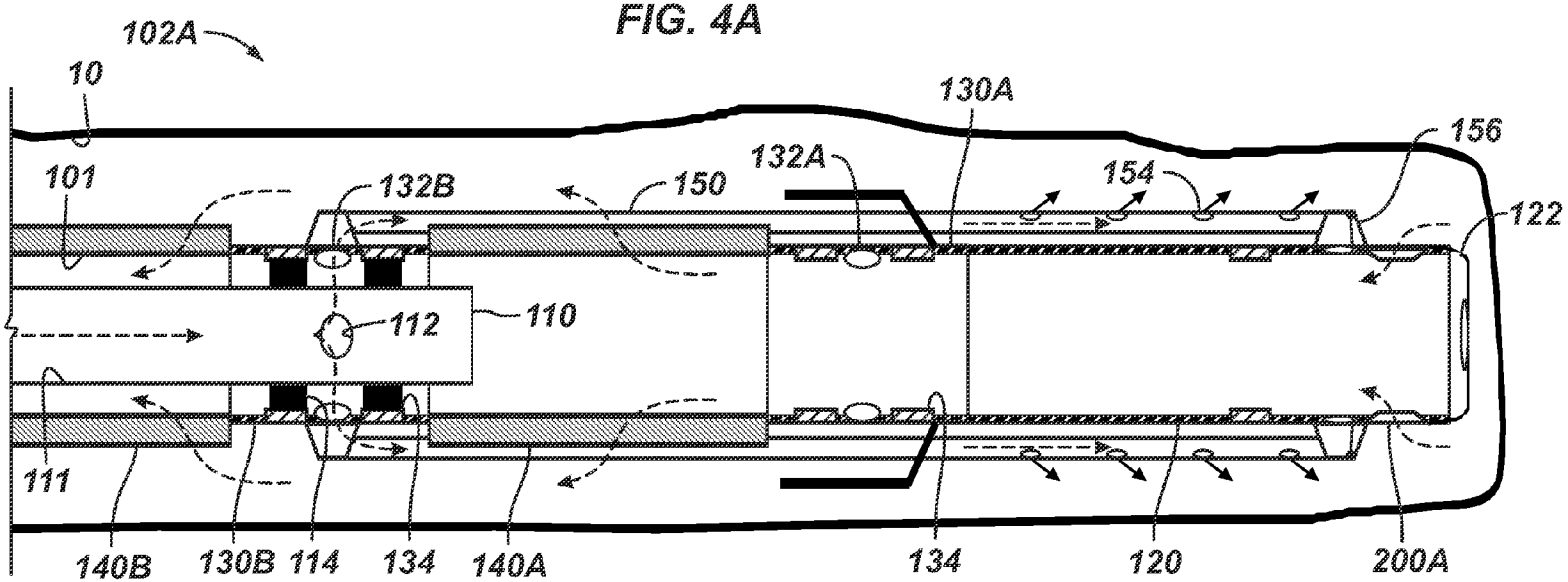

To do the operation, operators position the inner string 110 as shown in FIGS. 4A-4B. Here, the string's seals 114 engage the seats 134 around the second flow ports 132B between the screen sections 140A-B. Operators then pump slurry down the bore 111 of the inner string 110 to the outlet ports 112. For sand disposal, operators would pump clear fluid to force the excess slurry out of the inner string 110. Operators may also do the same for gravel packing, but may simply pump slurry alone depending on the implementation. In any event, the slurry flows from the outlet ports 112 and through the housing's flow ports 132B.

In general, the slurry can flow directly out of the flow ports 132B and into the surrounding annulus if desired. This is possible if one or more of the flow ports 132B communicate directly with the annulus and do not communicate with one of the alternate path devices or shunt 150. All the same, the slurry can flow out of the flow ports 132B and into the alternate path devices or shunts 150 for placement elsewhere in the surrounding annulus. As shown here, the shunts 150 can deliver the slurry toward the toe around the shoe track 120. Although shunts 150 are depicted in a certain way, any desirable arrangement and number of transport and packing devices for an alternate path can be used to feed and deliver the slurry.

Depending on the implementation as noted previously, this second stage of pumping slurry may be used to further gravel pack the borehole 10. Alternatively as also noted previously, pumping the slurry through the shunts 150 enables operators to evacuate excess slurry from the string 110 to the borehole annulus around the shoe track 120 without reversing flow in the string from the main flow direction (i.e., toward the string's ports 112). This is in contrast to the typical practice of reversing the direction of flow by pumping fluid down an annulus to evacuate excess slurry from a string.

To that end, the shunts 150 attached to the ported housing 130B above the lower screen section 140A can be used to dispose of excess gravel from the inner string 110 around the shoe track 120 (and optionally inside the shoe track 120 itself). As shown in FIG. 4B, the slurry travels from the outlet ports 112, through the flow ports 132B, and through the shunts 150. From the shunts 150, the slurry then passes out side ports or nozzles 154 in the shunts 150 and fills the annulus around shoe track 120. This provides the gravel packing operation with an alternate path different from the assembly's primary path of toe-to-heel packing of the annulus with gravel.

The shunts 150 carry the slurry down the lower screen section 140A so a washpipe does not need to be disposed in the shoe track 120. However, the bypass assembly 200A disposed in the assembly 100 near the float shoe 122 allows fluid returns during this process to enter the assembly 100.

As noted previously, the bypass assembly 200A can be a check valve, a screen portion, a sleeve, or other suitable device that allows the flow of fluid returns and not gravel from the borehole to enter the assembly 100. As a screen, the bypass assembly 200A can have any desirable length along the shoe track 120 depending on the implementation so that the depicted size of the bypass assembly 200A is merely meant to be a representation.

Fluid returns enter the shoe track 120 through this bypass assembly 200A, and the returns flow out the first screen section 140A, through surrounding gravel (not shown), and back in the upper screen section 140B. This allows the fluid returns to go around the sealed ports 112 and 132B. Finally, the fluid returns can then flow uphole in the annulus between the inner string 110 and assembly 100, eventually reaching the liner hanger 14 and unset service tool 18.

At some point, operations may reach a "sand out" condition or a pressure increase while pumping at the flow ports 132B. At this point, a valve, rupture disc, or other closure device 156 in the shunts 150 can open so any remaining gravel in the excess slurry can then fill inside the shoe track 120 after evacuating excess gravel around the shoe track 120. In this way, operators can evacuate more excess gravel inside the shoe track 120. As this occurs, fluid returns can pass out the lower screen section 140A, through the packed gravel, and back through upper screen section 140B to travel uphole.

In other arrangements of a bypass assembly, the lower ported housing 130A or other portions of the gravel pack assembly 100 can have a bypass, another shunt, or the like, which can be used to deliver fluid returns past the seals 114 and seats 134 and uphole. Details of other bypass assemblies according to the present disclosure are discussed later.

Figure 5A:
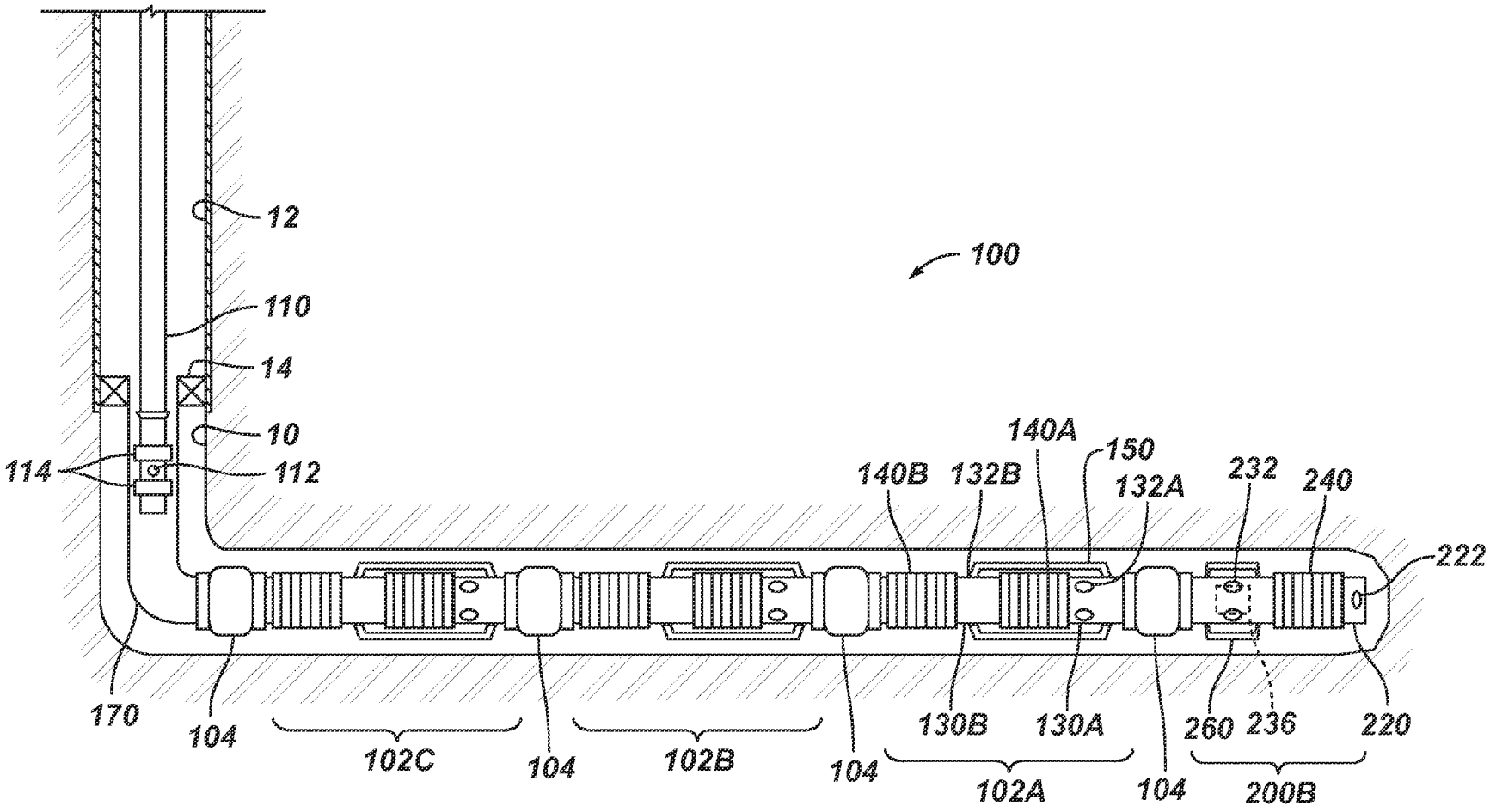
FIG. 5A shows another gravel pack assembly according to the present disclosure having screen sections separated by packers and having a bypass assembly disposed on the shoe track.

FIG. 5A shows another gravel pack assembly 100 having a liner 170 extending from a liner hanger 14 and having several gravel pack sections 102A-C separated by packers 104 disposed in a borehole 10. As before, this gravel pack assembly 100 can be similar to that discussed previously and to those disclosed in incorporated U.S. patent application Ser. No. 12/913,981.

The assembly 100 has another embodiment of a shoe track 220 having a bypass assembly 200B at the end of the gravel pack assembly 100. As shown, the bypass assembly 200B and shoe track 220 can be a separate section on the gravel pack assembly 100, being separated from the gravel pack sections 102A-C by one or more packers 104. Alternatively, the bypass assembly 200B can be incorporated into the gravel pack section 102A at the end of the assembly 100 without being separate from the section 102A in a way similar to the other bypass arrangement of FIGS. 3A-3B and 4A-4B.

After gravel packing the gravel pack sections 102A-C, operators preferably evacuate excess slurry from the inner string 110 as noted previously and use the exterior space outside the shoe track 220 for disposing of any gravel remaining in the inner string 110. Accordingly, the inner string 110 deploys to the shoe track 220, and excess slurry is pumped down and out of the inner string 110 and into the borehole annulus around the shoe track 220 as discussed previously. Meanwhile, the bypass assembly 200B allows fluid returns to enter a lower screen 240 and bypass the inner string's ports 112 so the fluid returns can go uphole to the surface.

Features of this bypass assembly 200B can be similar to those disclosed in incorporated U.S. application Ser. No. 13/345,500. Accordingly, the bypass assembly 200B has a bypass 260, which can be one or more internal passages or conduits (see FIG. 5B) defined in the bypass assembly 200B and having an inlet communicating on a first side of the flow ports 232 and an outlet communicating on a second side of the flow ports 232. Alternatively, the bypass 260 can be one or more tubes or conduits (see FIG. 5C) disposed outside the apparatus 100 and having a similar arrangement of inlet and outlet relative to the flow ports 232. Additionally, a closure or sleeve 236 in the bypass assembly 200B can be used to selectively open and close fluid communication through the flow ports 232 once excess slurry in the inner string 110 has been deposited in the wellbore around the shoe track 220. In fact, moving the closure or sleeve 236 can also selectively open and close fluid communication through the bypass 260.

Figure 5B:
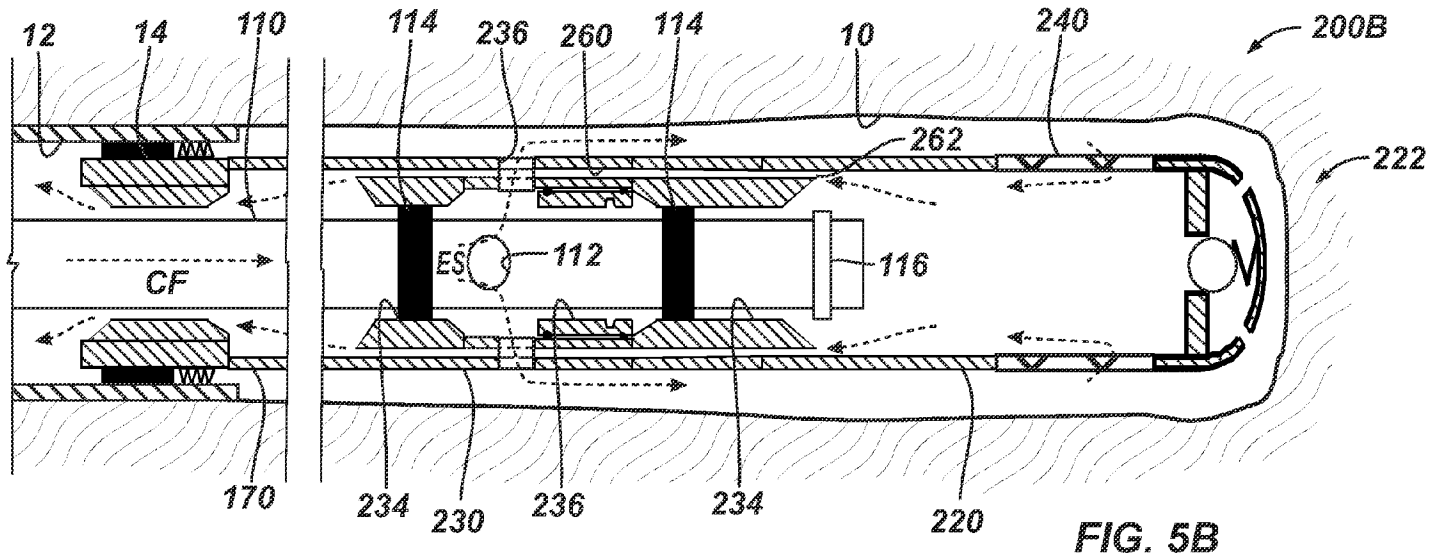
FIGS. 5B-5C show portions of a gravel pack assembly as in FIG. 5A during a sand disposal operation.

As shown in FIG. 5B, for example, the assembly 100 with the shoe track 220 and bypass assembly 200B is shown set up for a sand disposal operation. As discussed before, operators preferably evacuate excess slurry from the inner string 110 after gravel packing one or more sections (102) and can use the exterior space outside the shoe track 220 for disposing of any slurry remaining in the inner string 210.

As shown in FIG. 5B, the inner string's seals 114 locate and seal on the seats 234 uphole of the screen 220 in the sand disposal position. The seals 114 can use elastomeric or other types of seals disposed on the inner string 110, and the seats 234 can be polished seats or surfaces inside the shoe track 220 to engage the seals 114. Clear fluid CF is pumped through the inner string 110, and any excess slurry ES exits from the string 110 and passes through the ports 112 and 232, which direct the excess slurry ES into the borehole annulus. As this occurs, the excess slurry ES begins to fill the annulus around the float shoe 220. A shunt (not shown) or the like could be used to direct the excess slurry ES if desired.

As the excess slurry ES fills the annulus, fluid returns FR then flow through the screen 220, which prevents the gravel from entering the gravel pack assembly 100. The returns FR then flow up the shoe track 220 to the bypass 260. Here, the bypass 260 allows the fluid returns FR to flow up from the shoe track 220 and past the closure 236, the seats 234, and the flow ports 232. This allows the fluid returns FR to go around the engaged seals 114 and seats 234, circumventing the flow out the inner string 110. As noted previously, the bypass 260 can always be opened or can be opened and closed by movement of the sleeve 236. In other words, shifting of the sliding sleeve 236 can open and close fluid communication through the bypass 260 as well as the flow ports 232.

Leaving the bypass 260 uphole of the seats 234 and seals 114, the fluid returns FR exit into the annulus between the inner string 110 and the liner 170. Eventually, the fluid returns FR pass out of the liner 170 to the casing 12. In this way, the fluid returns FR can be delivered all the way uphole in the assembly 100 without needing to enter the inner string 110.

To prevent any potential sand from entering the bypass 260, the bypass' inlets 262 can be protected with sand screens (not shown). As is known, sand capable of collecting above the inner string 110 could cause the string 110 to stick. Therefore, addition of a screen at the entrance of the bypass 260 could further prevent sand from flowing up into the space above the closing sleeve 236.

Figure 5C:
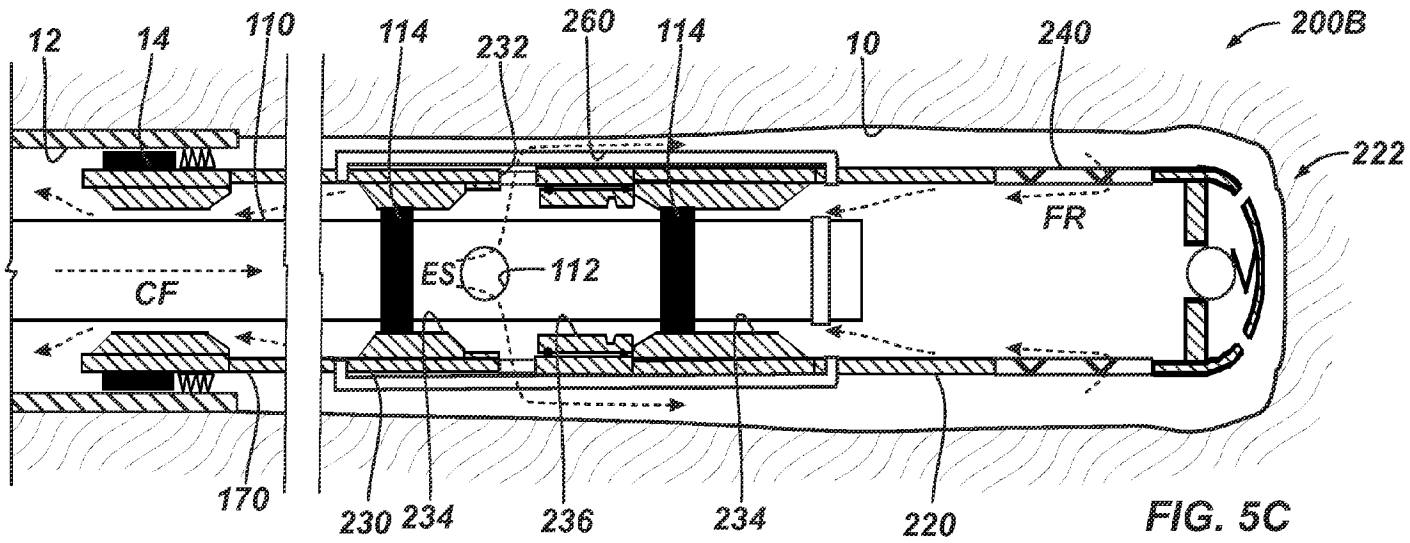

As shown in FIG. 5B, the bypass 260 can be one or more channels defined in the housing of the bypass assembly 200B. As an alternative, FIG. 5C shows the bypass 260 using one or more tubes disposed externally to the bypass assembly 200B. Either way, the bypass 260 bypasses the seats 234, flow ports 232, and the sliding sleeve 236 of the bypass assembly 200B to allow fluid returns to circumvent the sealing of the inner string's outlet ports 112 with the assembly's flow ports 232.

For its part, the sleeve 236 can be accessed by tool movement and an appropriate shifter 116 on the inner string 110 to move it relative to the outlet ports 232 between opened and closed positions. (The shifter 116 may be positioned elsewhere on the string 110 other than its position diagrammed in the Figures, and the shifter 116 may be able to open and close the sleeve 236 in opposing directions using features well known in the art.)

Figure 6:
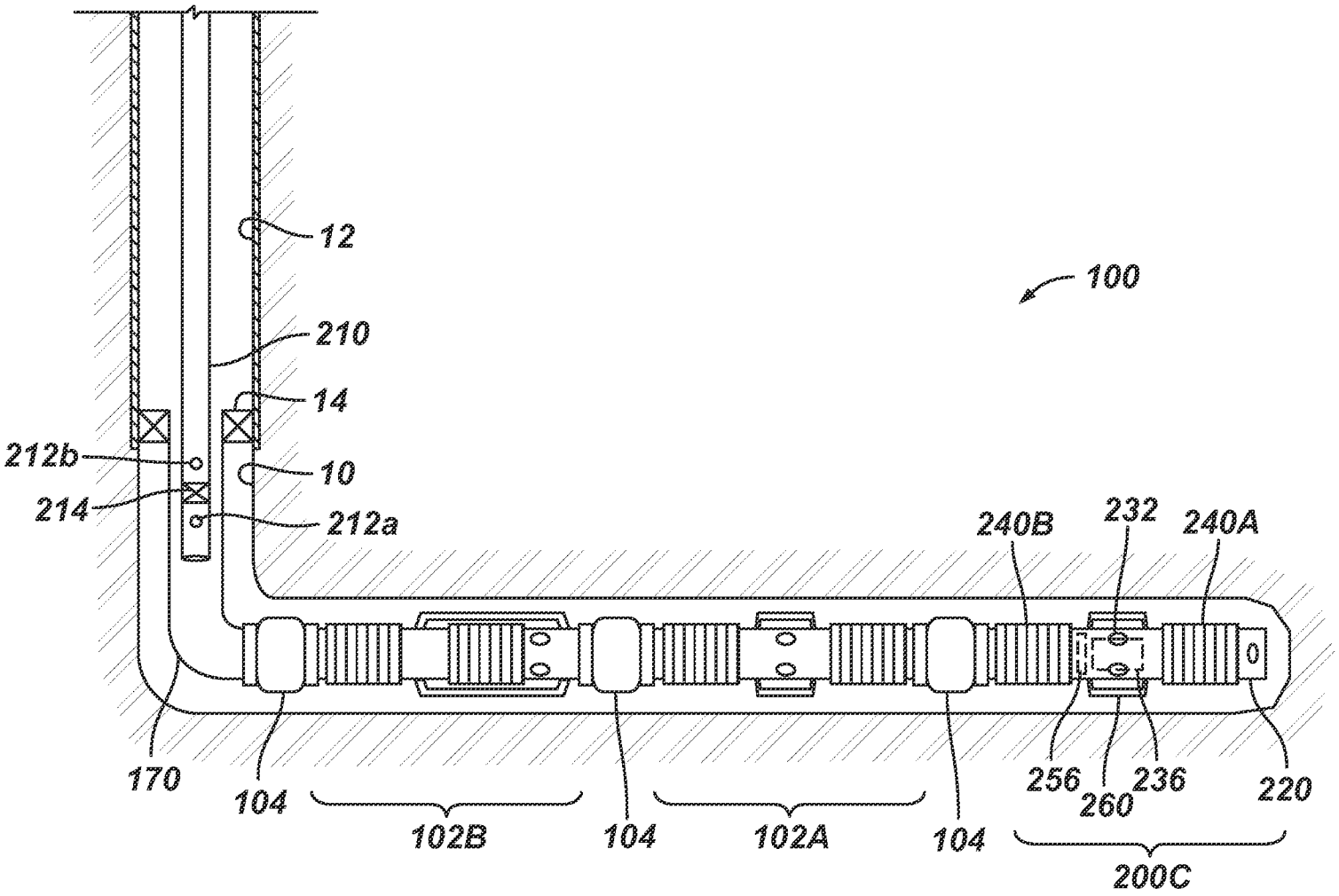
FIG. 6 shows yet another gravel pack assembly according to the present disclosure having screen sections separated by packers and having another bypass assembly disposed on the shoe track.

FIG. 6 shows yet another gravel pack assembly 100 having a liner 170 extending from a liner hanger 14 and having several gravel pack sections 102A-B separated by packers 104 disposed in a borehole 10. As before, this gravel pack assembly 100 can be similar to those discussed previously and to those disclosed in incorporated U.S. patent application Ser. Nos. 12/913,981 and 13/345,500. In fact, one section 102B can have a gravel pack assembly similar to that discussed above in FIGS. 2 through 4B.

The assembly 100 has another embodiment of a shoe track 220 having a bypass assembly 200C at the end of the gravel pack assembly 100. As again shown, the bypass assembly 200C and shoe track 220 can be a separate section on the gravel pack assembly 100, being separated from the gravel pack sections 102A-B by one or more packers 104. Alternatively, the bypass assembly 200C can be incorporated into a gravel pack section at the end of the assembly 100 without being separate in a way similar to the other bypass arrangement of FIGS. 3A-3B and 4A-4B. Moreover, features of the bypass assembly 200C can be used in other gravel pack sections on the assembly 100, such as shown in the gravel pack section 102A in FIG. 6.

Operators gravel pack the sections 102A-B as disclosed herein using an inner string 210 having a pair of outlet ports 212*a-b* separated by an internal plug 214. After gravel packing the other gravel pack sections 102A-B, operators preferably evacuate excess slurry from the inner string 210 as noted previously and use the exterior space outside the shoe track 220 for disposing of any gravel remaining in the inner string 210. Accordingly, the inner string 210 deploys to the shoe track 220, and excess slurry is pumped down and out of the inner string 210 and into the borehole annulus around the shoe track 220 as discussed previously.

Meanwhile, the bypass assembly 200C allows fluid returns to enter a lower screen 220 and bypass the inner string's outlet ports 212*a-b* so the fluid returns can go uphole to the surface. Once excess slurry in the inner string 110 has been deposited in the wellbore around the shoe track 220, a closure or sleeve 236 in the bypass assembly 200C can be used to selectively open and close fluid communication through the flow ports 232, or an isolation device 256 in the assembly 200C can seal off the lower portion of the shoe track 220.

Further details of the bypass assembly 200C are shown in FIGS. 7A through 10. Looking first at FIGS. 7A and 7B, the gravel pack assembly 100 is depicted run into a borehole 10. As before, a liner hanger 14 on the assembly 100 having a packer or other sealing device is set so that the hanger 14 seals the liner 170 of the assembly 100 in the casing 12. Downhole in the open borehole 10, the assembly 100 has the bypass assembly 200C, which includes an uphole screen 240B extending from the liner 170, a bypass housing 230 extending from the uphole screen 240B, a downhole screen 240A extending from the bypass housing 230, and a shoe track 220 extending from the downhole screen 240A toward the toe of the borehole 10. Other screen assemblies can be disposed uphole of the assembly 100 shown in FIG. 7B as noted herein, and the screens 240A-B can have any desirable length.

The bypass housing 230 has one or more flow or body ports 232 so slurry exiting an inner string or washpipe 210 can enter into the borehole annulus around the assembly 100. The bypass housing 230 also has several sealing elements or seats 234*a-c* disposed along its interior to seal against the inner string 210 when situated in different positions. The assembly's internal seats 234*a-c* are arranged to seal against the inner string 110 to allow fluid access through various ports and in various directions depending upon the inner string's position. A downhole seat 234*a* is located toward the toe downhole of the bypass 260's downhole end. A pair of seats 234*b-c* is disposed inside the ends of the bypass 260 to isolate the assembly's flow ports 232, which is located between the pair of seats 234*b-c*.

Finally, the bypass housing 230 has a bypass 260 that connects a downhole section of the assembly's interior 101 to an uphole section. In this way, the bypass 260 bridges around the flow ports 232 in the bypass housing 230, while the inner string 210 can be fluidly isolated in the assembly 100 using the seats 234*a-c* in the interior.

The inner string 210 has an internal bore 211 to convey fluid and has an open distal end 213 and outlet ports 212*a-b* to allow fluid to flow out of the inner string 210. Between the string's outlet ports 212*a-b*, the string's bore 211 has a fluid stop 214. In general, this stop 214 can be a plug, a bridge plug, a packer, a valve, a ball and seat, an integral component of the inner string 110, or any other structure, either permanent or not, to prevent fluid flow therepast in the string's bore 111. Essentially, the inner string 210 has separate fluid passages or pathways. A first fluid passage extends in the bore 111 from the surface to the uphole outlet port 212*b* and is used for conveying slurry, washdown fluid, and the like to the assembly 100. A second fluid passage extends from an inlet opening at the string's distal end 213 to the downhole outlet port 212*a*. This second fluid passage is used to communicate fluid returns from the downhole screen 240 to the bypass 260 as discussed below.

Figure 7A:
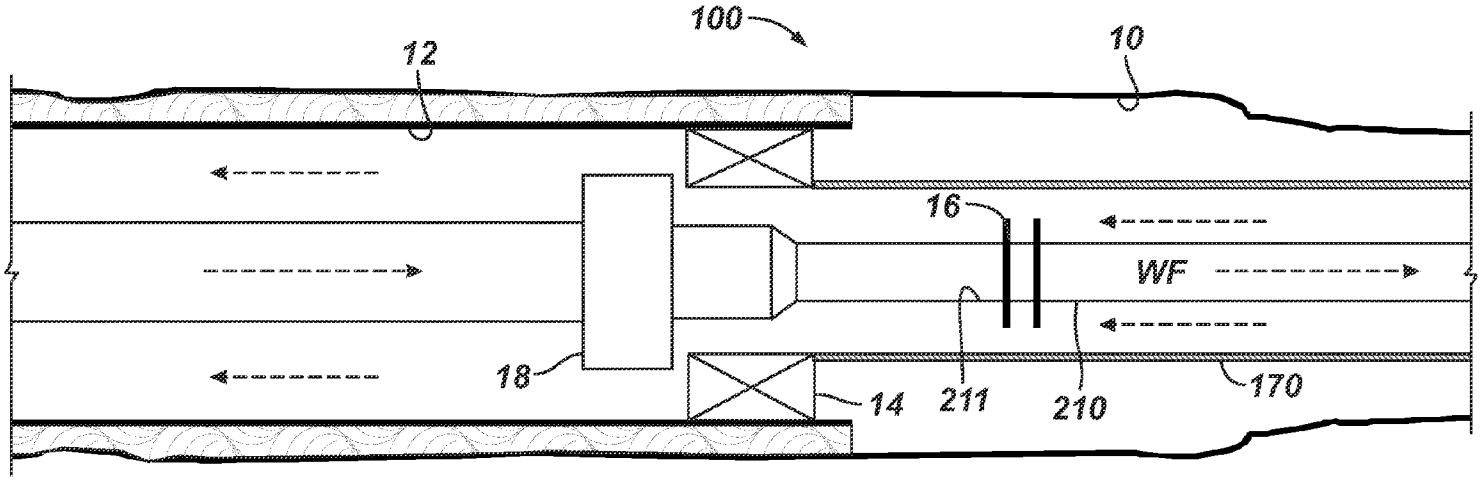
FIGS. 7A-7B depict uphole and downhole ends of a gravel pack assembly having a bypass assembly according to the present disclosure as in FIG. 6.
Figure 7B:
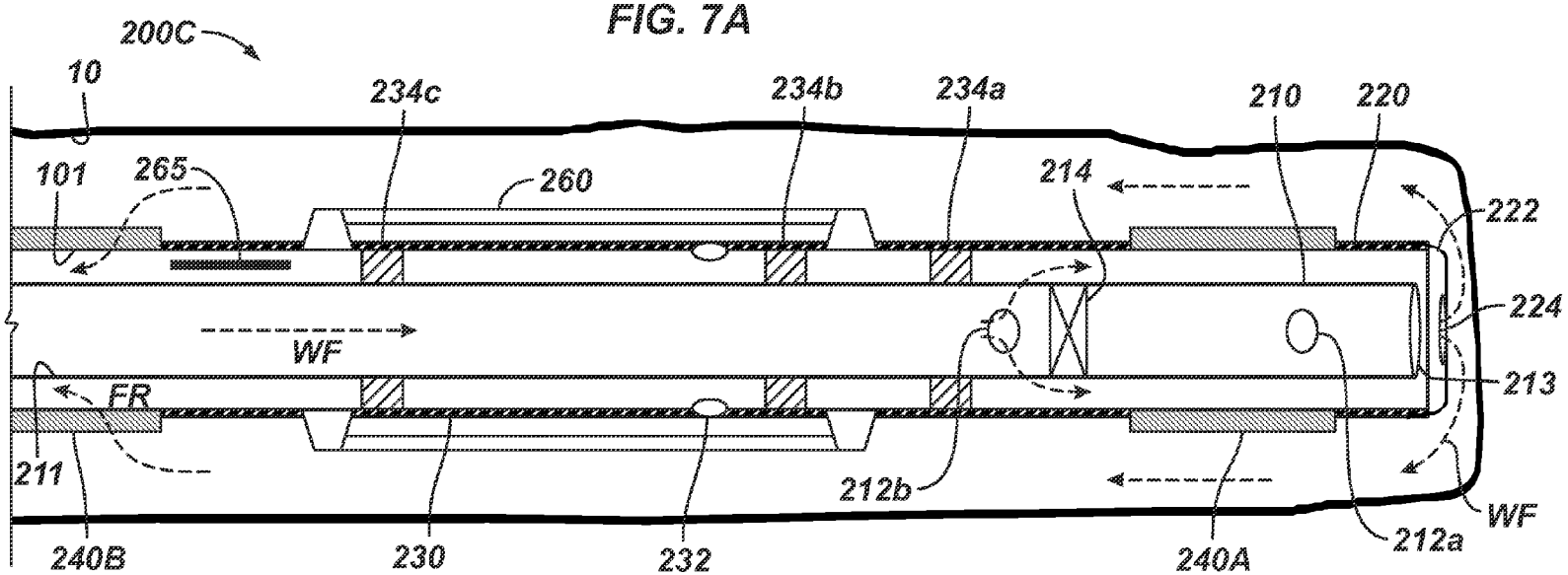

In the position shown in FIGS. 7A-7B, the inner string 210 is run into the borehole 10 and passes into and through the liner hanger 14. At this stage, the inner string 210 disposes through the assembly 100 with the distal end extending to the shoe track 220 to perform a washdown operation.

Uphole in FIG. 7A, the service tool 18 sits on the liner hanger 14 in the casing 12, and seals 16 on the service tool 18 do not seal in the liner hanger packer 14 so hydrostatic pressure can be transmitted past the seals 16. Downhole in FIG. 7B, the distal end of the inner string 210 fits through the screen sections 240A-B and seals against the seat 234*a-c* near the float shoe 222 on the assembly's shoe track 220. As depicted, the inner string 210 can be a polished pipe that sealably engages the seats 234*a-c* so that fluid cannot pass. Alternatively, as disclosed above, the inner string 210 can have external seal elements (not shown) disposed thereabout that are intended to engage the seats 234*a-c* when the inner string 210 is disposed in particular positions in the assembly 100. Any number of sealing engagements known and used in the art can be used for the assembly 100.

Operators circulate washdown fluid WF down the bore 211 of the inner string 210, and the circulated fluid WF flows out the ports 212*b*, through the check valve 224 in the float shoe 222, up the borehole annulus, and around the unset packer of the liner hanger 14 (FIG. 7A). Fluid returns FR can also flow into the interior 101 of the assembly 100 through the screens 240A-B and flow uphole past the liner hanger 14.

Figure 8A:
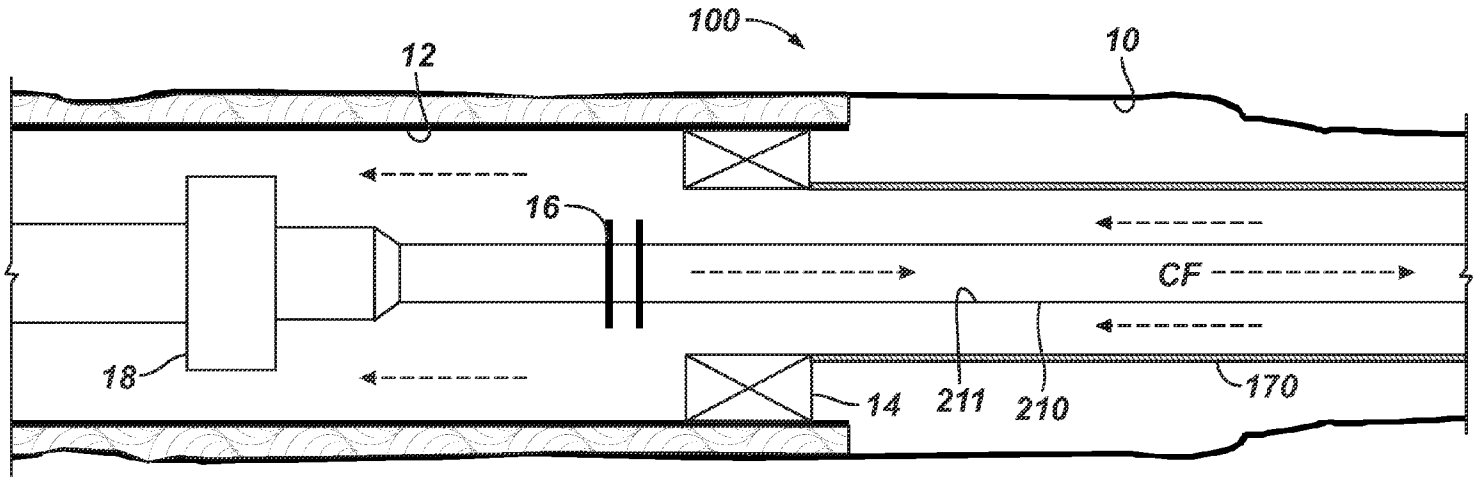
FIGS. 8A-8B depict the uphole and downhole ends of the disclosed assembly as transport fluid and gravel are pumped downhole with the inner string.
Figure 8B:
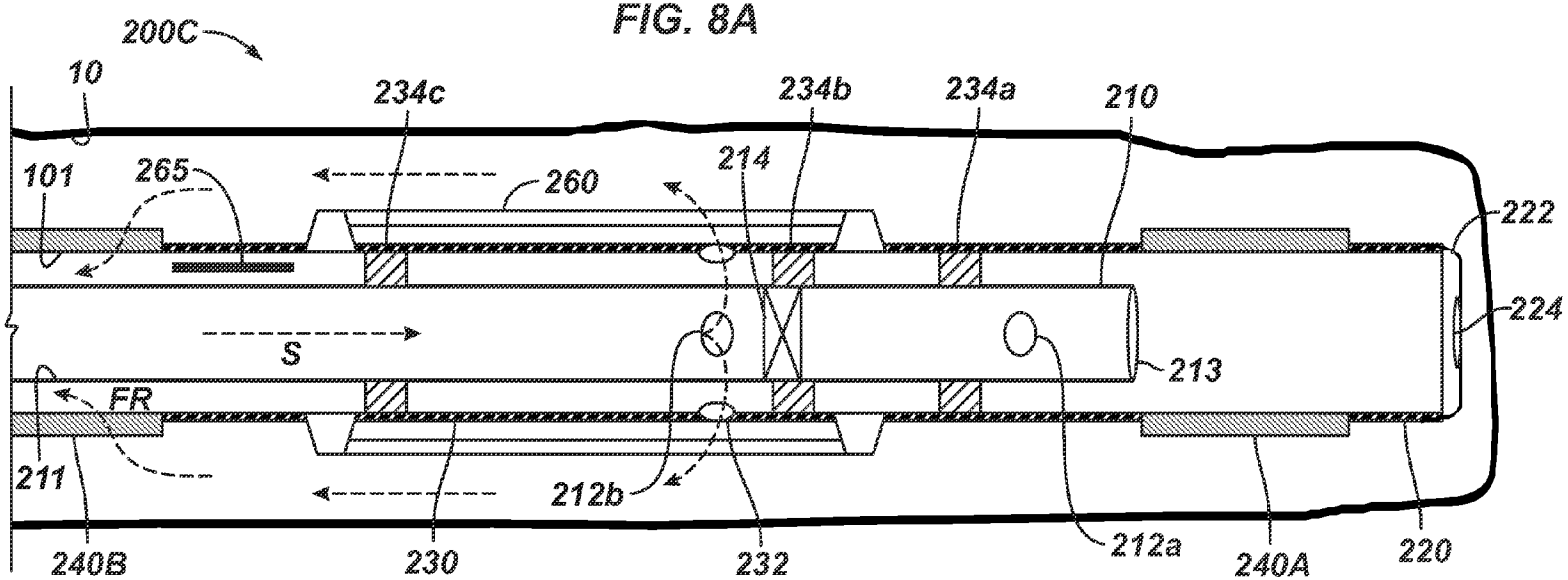

After washdown, operators can set any packers (e.g., 104) along the assembly 100 between the various sections (e.g., 102A-B: FIG. 6) if present. Then operators can gravel pack around the uphole screen 240 on the bypass assembly 200C or can gravel pack other sections (102A-B) first. Either way, the inner string 110 as depicted in FIGS. 8A-8B is run into the assembly 100 so that the uphole outlet ports 212*b* communicates with the flow ports 232 in the bypass housing 230.

Slurry S is pumped down the bore 211 of the inner string 210. The pressure from the pumps used to pump the slurry S from the surface is exerted upon the inner string 210 and avoids the formation or borehole 10. As the slurry S continues down the inner string 210, it passes uninterrupted by the liner hanger 14 and continues down the inner string 210 until it reaches the inner string's outlet ports 212*b* and the stop 214. The slurry S then flows out of the inner string 210 into the annular area inside the bypass housing 230, which is sealed off by the seats 234*b-c*. The slurry S is then forced out though the flow ports 232 and into the annulus around assembly 100.

Because the flow ports 232 are near the toe of the borehole 10, the slurry S tends to flow towards the uphole end or heel of the borehole 10. As the slurry S reaches the uphole screen 240B, the transport fluid of the slurry S is drained out of the slurry S, and the fluid returns FR flow through the screen 240B into the interior of the assembly 100, thus provoking a gravel packing Alpha wave to form. As gravel packing continues, a subsequent Beta wave packs the annulus of the borehole 10 from the heel to the toe.

Meanwhile, the fluid returns FR drained from the slurry S pass through the interior 101 of the assembly 100 and travel towards the liner hanger 14. Passing the hanger 14, the fluid returns FR flow between the inner string 110 and the borehole 10 (or in some instances the casing 12) and then to the surface.

Typically, when the borehole 10 is packed-off, operators will notice a pressure spike at the surface. When this occurs, the pumps are shut off, and the inner string 210 is prepared to be removed. However, sand or gravel left in the inner string 110 when moved may fill the interior of the screen assembly 100, which is not desirable. To minimize any excess sand or gravel being dumped in the screen assembly 100, any excess slurry in the inner string 110 is preferably removed from the inner string 110 and dumped in the borehole annulus around the screen assembly 100.

Figure 9A:
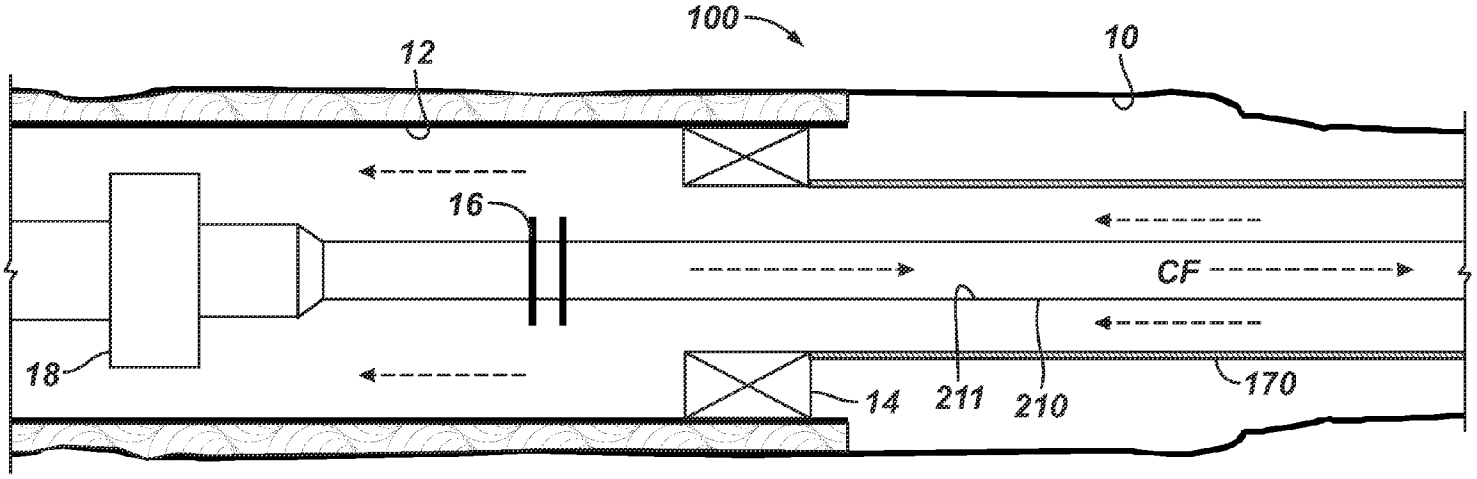
FIGS. 9A-9B depict the uphole and downhole ends of the assembly as excess slurry in the inner string is dumped in the borehole annulus around the shoe track.
Figure 9B:
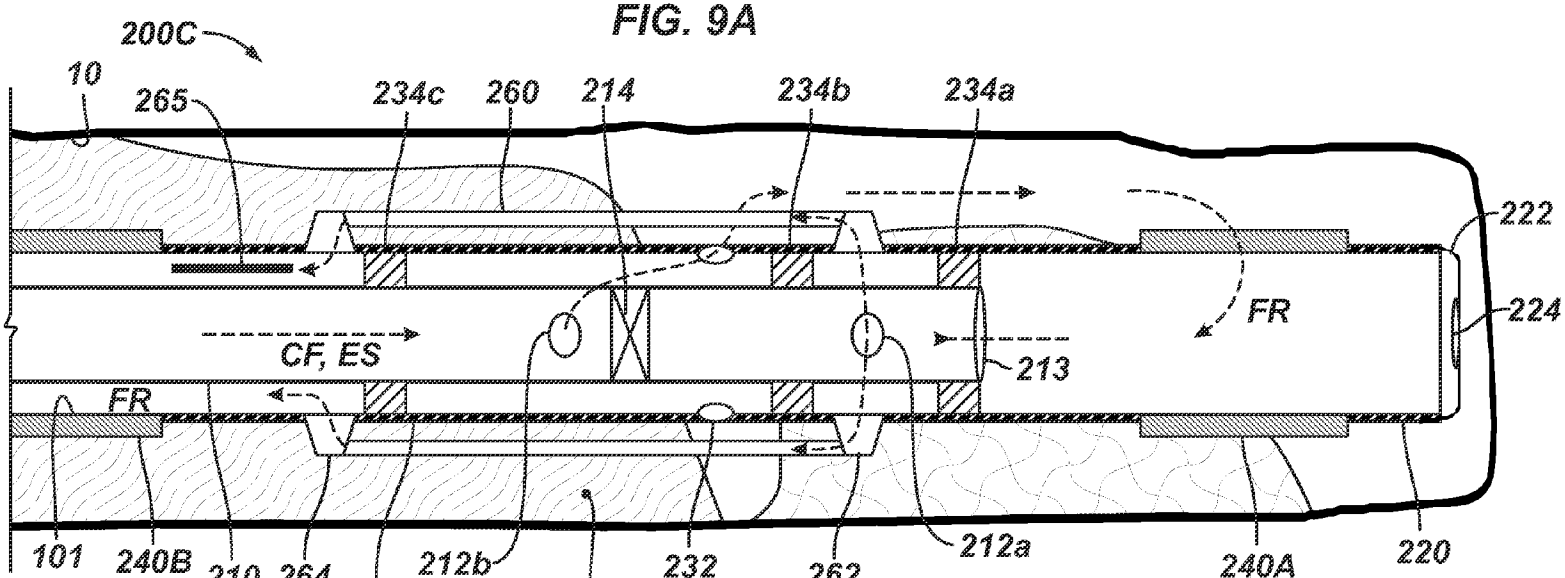

As depicted in FIGS. 9A-9B, the inner string 210 is raised so the downhole outlet ports 212*a* in the inner string 210 seals in communication with the inlet 262 of the bypass 260. This allows any remaining gravel to be backwashed out of the inner string 210, while leaving the existing gravel pack GP intact around the uphole screen 240B.

To dispose of the excess slurry, operators pump clear fluid CF down the bore 211 of the inner string 210. The clear fluid CF and any excess slurry ES from the inner string 210 passes out of the outlet ports 212*a* and through the flow ports 232 in the bypass housing 230 as before. Now, however, because the gravel pack GP fills the annulus towards the heel of the borehole 10, the clear fluid CF and excess slurry ES moves towards the toe of the borehole 10 where the downhole screen 240A on the shoe track 220 is located. Typically, the amount of slurry that was initially pumped during the gravel pack operation was pre-calculated to just fill the annulus around the uphole screen 240B. Therefore, the amount of excess slurry ES that remains in the inner string 110 may not be enough to pack gravel fully around the assembly's downhole screen 240A, but this can be calculated as well.

The excess slurry ES begins to pack the borehole annulus around the downhole screen 240A in an alpha-beta wave configuration. The transport fluid is drained away from the excess slurry ES through the downhole screen 240A. Entering the assembly's interior 101, the fluid returns FR travels through the open distal end 213 and into the inner string's bore 211. The fluid FR then passes up towards the downhole outlet ports 212*a*, which are sealed in communication with the inlet 262 of the bypass 260. The fluid FR then flows through the bypass 260 without interfering with the flow ports 232 in the bypass housing 230. At the bypass' outlet 264, the fluid returns FR flow back in the assembly's interior 101, where the fluid returns FR can eventually flow uphole past the liner hanger 14 and to the surface.

Figure 10:
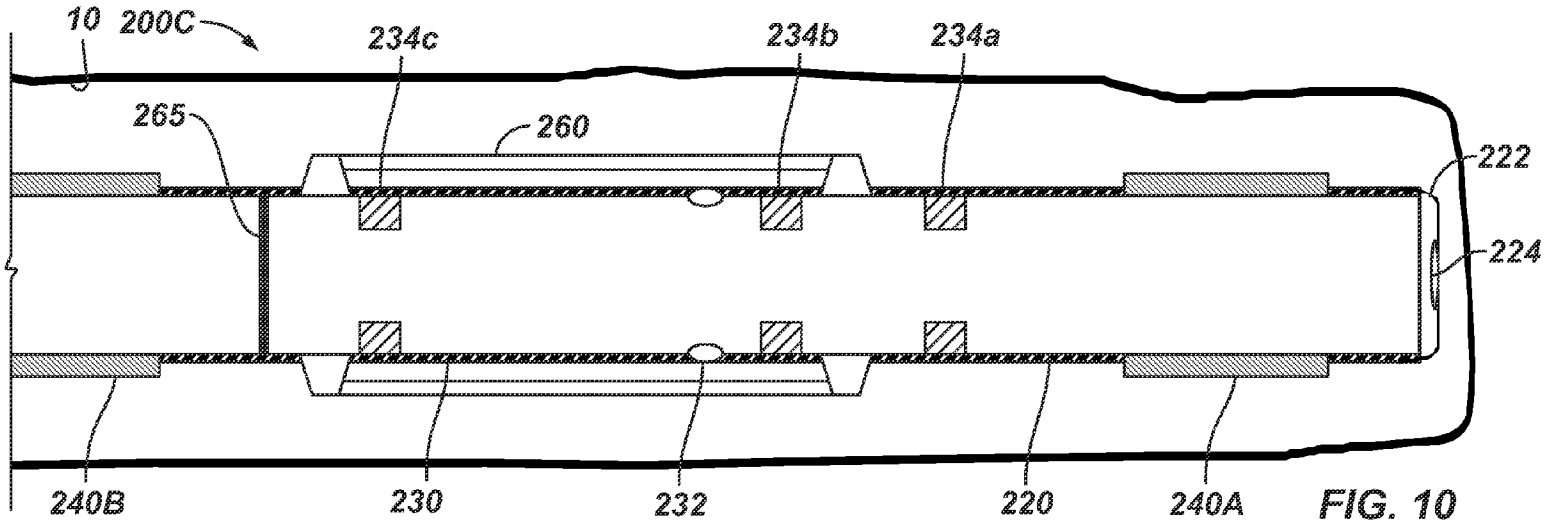
FIG. 10 depicts the downhole end of the disclosed assembly after the inner string has been removed and the wellbore isolation device has been activated.

As depicted in FIG. 10, after the sand disposal operation is complete, the inner string 210 is removed from the assembly 100. A wellbore isolation device 265, such as a flapper valve, can then be closed in the assembly 100 to seal off the bypass housing 230 and the shoe track 220. This can prevent fines, gravel, sand, and the like from entering the assembly's interior 101 through the flow ports 232. Alternatively, the wellbore isolation device 265, such as a bridge plug, can be deployed independently into the assembly 100 and activated.

In general, the device 265 may consist of a flapper valve, an elastomer plug, a swellable elastomer plug, a sliding sleeve, a bridge plug, or another device to close off fluid flow through the flow ports 232. Once activated, the wellbore isolation device 265 prevents fluid or gravel from entering the interior 101 of the assembly 100 through the flow ports 232, which could contaminate any produced fluids.

Figure 11:
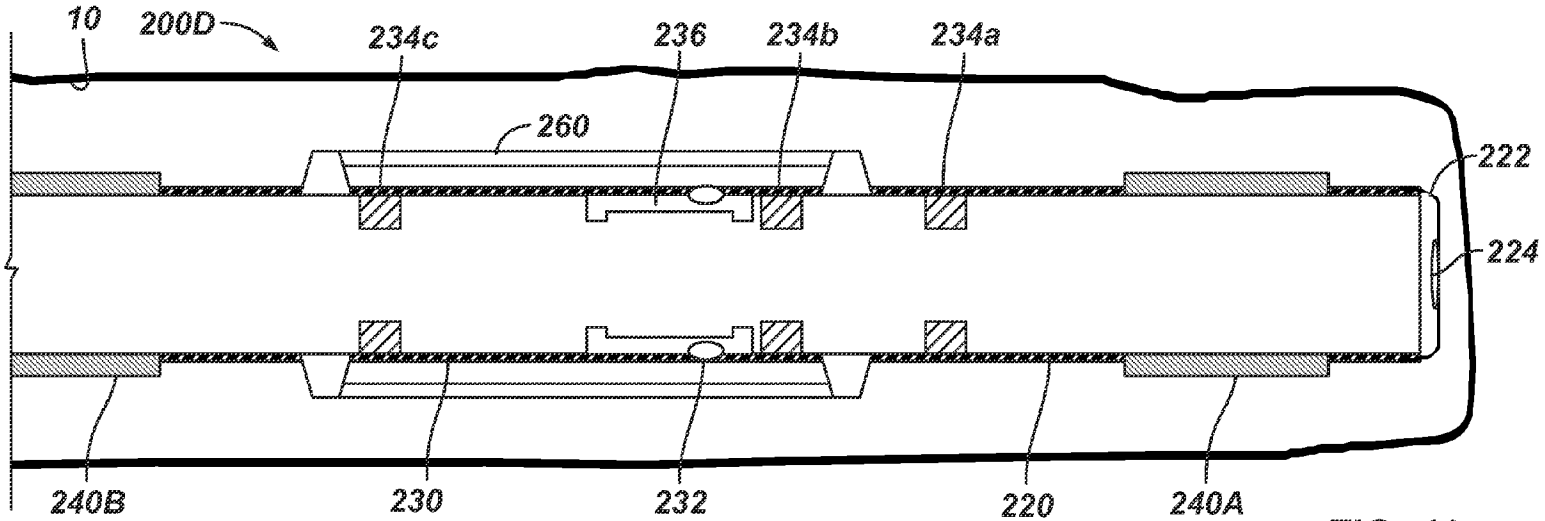
FIG. 11 depicts the downhole end of the disclosed assembly having the inner string removed and having a valve at the assembly's flow port.

As an alternative, a bypass assembly 200D in FIG. 11 uses an isolation device 236 in the bypass housing 230 to close fluid communication through the flow ports 232. In general, this device 236 can be a check valve, a sliding sleeve, a rotating sleeve, a packer with a throughbore, or a screen controlling fluid communication through the flow ports 232. As shown in the present example, the device 236 is a sliding sleeve that can be used to selectively block the flow ports 232 after expelling excess slurry in the borehole 10 around the shoe track 220 according to the procedures disclosed above. The sleeve 236 can be opened and closed using a shifting tool disposed on the inner string (not shown) or on another device deploying in the assembly 200D.

Figure 12:
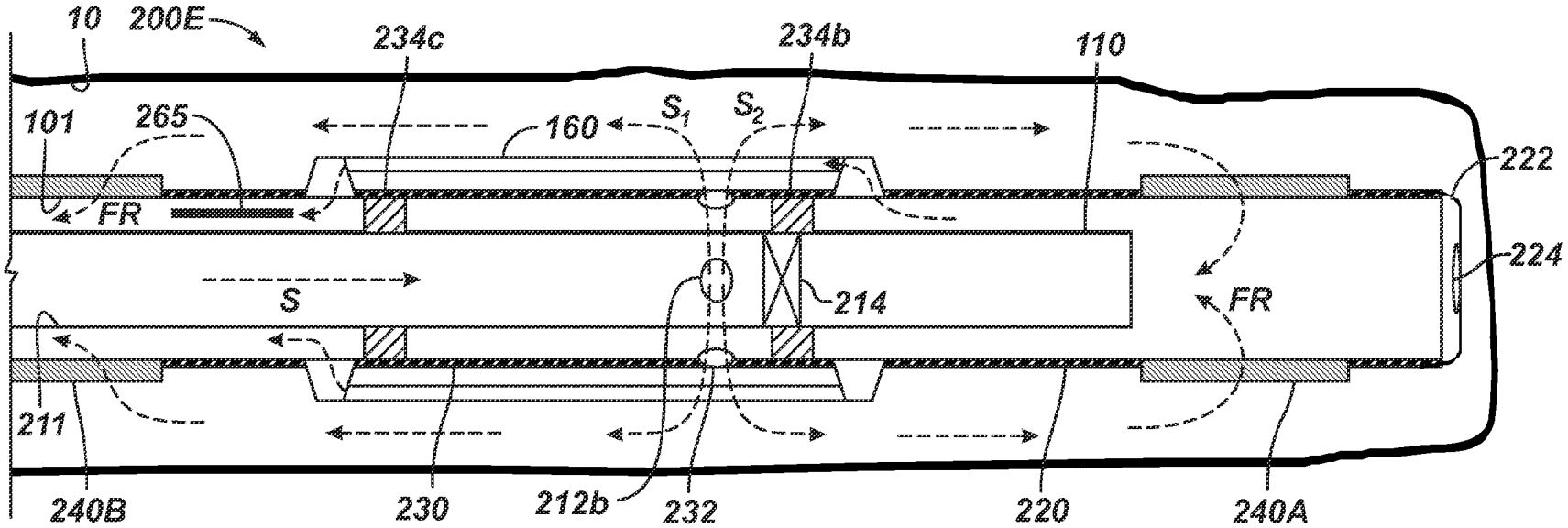
FIG. 12 depicts a downhole end of yet another gravel pack assembly according to the present disclosure in which the inner string in one position can gravel pack both uphole and downhole.

As depicted in FIG. 12, certain embodiments the gravel packing operation may consist of packing the gravel in two directions. The transport fluid and gravel in the slurry S are pumped down the interior of the inner string 210 to gravel pack the borehole annulus in both directions. In most instances, the transport fluid and the gravel used in the slurry S to pack both the uphole and downhole sections of the borehole annulus may be composed of the same or similar components.

In other instances, a first slurry $S_1$ of transport fluid and gravel can be pumped down the interior 211 of the inner string 210, and then a second slurry $S_2$ of transport fluid and gravel can be pumped. In most cases, the first slurry $S_1$ will pack off the uphole section of the borehole 10 around the uphole screen 240B, which may have a longer extent than the downhole screen 240A. Then, the second slurry $S_2$ may pack off the annulus around downhole screen 240A. In other instances, the annular areas outside of both screens 240A-B may be packed off at the same time or in other sequences.

As before, the slurry S exiting the inner string's uphole outlet ports 212*b* enters the sealed area in the bypass housing 230 between the sealing elements 234*b-c* and passes out through the flow ports 232 into the borehole annulus. At this point, the slurry S can move towards both the heel and the toe of the wellbore depending on flow resistance. For example, gravel from the slurry S can pack the annulus along the upper screen 240B before packing around the downhole screen 240A. At this downhole screen 240A, however, fluid returns FR entering through the screen 240A moves up towards the bypass housing 230. As before, the inner string 110 has an open distal end 213 and a stop 214, but it may simply have a closed distal end 213. Prevented from traveling further, the fluid returns FR travel through the bypass 260 to the uphole interior of the assembly 100, where the fluid returns FR can travel to the surface as before.

In the bypass assembly 200E of FIG. 12, the bypass housing 230 may lack a downhole seal (see e.g., 234*a* in FIG. 9B), and the inner string 110 may lack a downhole outlets (see e.g., 212*a* in FIG. 9B). Yet, the bypass housing 230 can operate equally as well with these elements being present, similar to the arrangement of FIGS. 8B and 9B.

To prevent gravel or other particulate matter from entering the assembly 100 and contaminating any produced fluid in those instances where production through both screen 240A-B may be desired, it may be necessary to block the flow ports 232 into the interior of the assembly 100 after gravel packing. Ways to do this are described above in FIG. 10, which uses the isolation device 265, and in FIG. 11, which uses the closure device 236.

The foregoing description of preferred and other embodiments is not intended to limit or restrict the scope or applicability of the inventive concepts conceived of by the Applicants. It will be appreciated with the benefit of the present disclosure that elements of one embodiment can be combined with or exchanged for components of other embodiments disclosed herein. Reference has been made herein to use of the gravel pack assemblies in boreholes, such as open boreholes. In general, these boreholes can have any orientation, vertical, horizontal, or deviated. For example, a horizontal borehole may refer to any deviated section of a borehole defining an angle of 50-degrees or greater and even over 90-degrees relative to vertical.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A gravel pack apparatus for a borehole, comprising:

a body having a body passage communicating from a heel to a toe and defining a first body port communicating the body passage with the borehole;

an inner string movably deploying in the body passage and defining a first fluid pathway with a first outlet port, the first outlet port of the inner string in a first selective position in the body passage selectively sealing with the first body port and communicating slurry from the first fluid pathway through the first outlet port to the borehole;

a first screen disposed on the body between the first body port and the toe and communicating the body passage with the borehole, the first screen for passing fluid returns of the slurry from the borehole into the body passage; and a bypass disposed on the body and communicating the body passage on a first side of the first body port to a second side of the first body port, the bypass for passing the fluid returns in the body passage past the first outlet port of the inner string when selectively sealed with the first body port, wherein the inner string defines a second fluid pathway in fluid isolation from the first fluid pathway, the second fluid pathway of the inner string in the first selective position being isolated from the bypass on the first side of the body port.

2. The apparatus of claim 1, further comprising a second screen disposed on the body uphole of the first body port and communicating the body passage with the borehole, the second screen passing fluid returns of the slurry communicated out of the first outlet port from the borehole into the body passage.

3. The apparatus of claim 2, further comprising an isolation element disposed on the body uphole of the second screen and sealing against the borehole.

4. The apparatus of claim 2, wherein the inner string deployed in the first selective position in the body passage flows the slurry from the first body port toward the heel of the body and packs the borehole around the second screen.

5. The apparatus of claim 4, wherein the inner string in a second selective position maintains the first outlet port sealed in fluid communication with the first body port and places the second fluid pathway in fluid communication with the bypass on the first side of the first body port, whereby the inner string flows the slurry from the first body port toward the toe of the body and packs the borehole around the first screen.

6. The apparatus of claim 5, wherein the bypass on the first side of the first body port receives the fluid returns of the first screen communicated from the second fluid pathway of the inner string in the second selective position.

7. The apparatus of claim 1, wherein the body defines a second body port downhole of the first screen toward the toe; and wherein the inner string moved to a second selective position in the body passage seals the first outlet port in fluid communication with the second body port.

8. The apparatus of claim 7, wherein the second body port comprises a valve permitting fluid communication from the body passage to the borehole and preventing fluid communication from the borehole into the body passage.

9. The apparatus of claim 1, wherein the inner string in a second selective position seals the first outlet port in fluid communication with the first body port and places the second fluid pathway in fluid communication with the bypass on the first side of the body port, the second fluid pathway communicating the fluid returns from the first screen to the bypass.

10. The apparatus of claim 1, wherein the second fluid pathway comprises:

a second outlet port defined in the inner string between the first outlet port and a distal end of the inner string; and an inlet port defined in the inner string toward the distal end and in fluid communication with the second outlet port.

11. The apparatus of claim 1, wherein the bypass comprises a conduit disposed outside the body, the conduit having an inlet in fluid communication with the body passage on the first side of the first body port and having an outlet in fluid communication with the body passage on the second side of the first body port.

12. The apparatus of claim 1, wherein the bypass comprises an internal passage defined in the body, the internal passage having an inlet in fluid communication with the body passage on the first side of the first body port and having an outlet in fluid communication with the body passage on the second side of the first body port.

13. The apparatus of claim 1, wherein the body comprises a closure selectively opening and closing fluid communication through the first body port.

14. The apparatus of claim 13, wherein the closure comprises a sleeve disposed in the body passage and movable therein between opened and closed conditions relative to the first body port.

15. The apparatus of claim 13, wherein the closure selectively opens and closes fluid communication through the bypass in conjunction with the selective opening and closing of the fluid communication through the first body port.

16. The apparatus of claim 1, wherein the first body port comprises a check valve, a sliding sleeve, a rotating sleeve, or a screen controlling fluid communication through the first body port.

17. The apparatus of claim 1, wherein the body comprises seats disposed in the body passage on each side of the first body port; and wherein the inner string comprises:

seals disposed on each side of the first outlet port and sealing with the seats, or polished surfaces on each side of the first outlet port and sealing with the seats.

18. The apparatus of claim 1, further comprising an isolating element disposed in the body passage uphole of the first body port and selectively isolating the body passage downhole therefrom.

19. A gravel pack apparatus for a borehole, comprising:

a body deploying in the borehole, the body having a body passage communicating from a heel to a toe and defining a first body port communicating the body passage with the borehole;

an inner string deploying in the body passage, the inner string defining a first fluid pathway with a first outlet port and defining a second fluid pathway in fluid isolation from the first fluid pathway;

means for selectively communicating slurry from the first fluid pathway of the inner string to the borehole through the first outlet port in sealed fluid communication with the first body port;

first means disposed on the body downhole from the first body port for screening fluid returns of the slurry from the borehole into the body passage; and means disposed on the body for selectively bypassing the fluid returns from a downhole side to an uphole side of the first body port, wherein the means for selectively communicating the slurry from the inner string in a first selective position in the body passage isolates the second fluid pathway from the means for bypassing and prevents fluid communication therethrough.

20. The apparatus of claim 19, wherein the means for selectively communicating the slurry comprises means for selectively sealing the inner string in fluid communication with the first body port.

21. The apparatus of claim 19, wherein the means disposed on the body for bypassing the fluid returns comprises means disposed externally on the body for communicating the screened fluid return.

22. The apparatus of claim 19, wherein the means disposed on the body for bypassing the fluid returns comprises means disposed internally in the body for communicating the screened fluid return.

23. The apparatus of claim 19, wherein the body defines a second body port disposed downhole of the first means for screening; and wherein the apparatus comprises means for selectively sealing the inner string in a second selective position in fluid communication with the second body port.

24. The apparatus of claim 23, wherein the second body port comprises means for communicating fluid from the body passage to the borehole and for preventing fluid communication from the borehole to the body passage.

25. The apparatus of claim 19, further comprising second means disposed on the body uphole of the body port for screening the fluid returns of the slurry from the borehole into the body passage.

26. The apparatus of claim 19, wherein the means for selectively communicating the slurry comprises means for sealing the inner string in the first selective position in the body passage and for preventing the bypass of the fluid returns through the means for bypassing from the downhole side to the uphole side of the first body port.

27. The apparatus of claim 19, further comprising means disposed on the body for opening and closing fluid communication through the first body port.

28. The apparatus of claim 19, further comprising means for isolating the body passage uphole of the first body port.

29. The apparatus of claim 19, wherein the means for selectively communicating the slurry from the inner string in a second selective position in the body passage permits fluid communication of the fluid returns through the second fluid passageway of the inner string to the means for bypassing.

30. The apparatus of claim 29, wherein the means for selectively communicating the slurry from the inner string in the second selective position comprises means for sealing the inner string in the second selective position in the body passage with the second fluid pathway in communication with the means for bypassing and for permitting bypass of the fluid returns from the downhole side to the uphole side of the first body port through the means for bypassing.

31. A gravel packing method for a borehole, the method comprising:

deploying an inner string inside a body disposed in a borehole;

selectively sealing the inner string in a first selective position in fluid communication with a first body port in the body, pumping slurry from the inner string into the borehole through the first body port, passing fluid returns from the borehole into the body through a first screen disposed downhole of the first body port, and communicating the fluid returns in the body from the first screen through a bypass on the body around the sealed fluid communication between the inner string and the first body port; and selectively sealing the inner string in a second selective position in fluid communication with the first body port of the body, pumping the slurry from the inner string into the borehole through the first body port, and isolating fluid communication to the bypass, and passing the fluid returns from the borehole into the body through a second sand screen disposed uphole of the first body port.

32. The method of claim 31, wherein selectively sealing the inner string in the second selective position is performed before selectively sealing in the first selective position.

33. The method of claim 31, further comprising selectively closing the first body port.

34. The method of claim 31, further comprising selectively closing the body uphole of the first body port.

35. The method of claim 31, wherein selectively sealing the inner string in the second selective position, flowing the slurry from the first body port toward the heel of the body, and passing the fluid returns from the borehole into the body through the second screen disposed uphole of the first body port comprises packing the borehole around the second screen.

36. The method of claim 31, wherein selectively sealing the inner string in the first selective position comprises flowing the slurry from the first body port toward the toe of the body, passing the fluid returns from the borehole into the body through the first screen, and packing the borehole around the first screen.

37. The method of claim 31, wherein the method comprises selectively sealing the inner string in a third selective position in the body passage and providing fluid communication from the inner string to the borehole through a second body port disposed downhole of the first body port.

* * * * *